US005884613A

United States Patent [19]

Kitamura et al.

[11] Patent Number: 5,884,613

[45] Date of Patent: Mar. 23, 1999

[54] AIR-FUEL RATIO CONTROL SYSTEM FOR INTERNAL COMBUSTION ENGINES

[75] Inventors: Toru Kitamura; Akira Kato; Naohiro Kurokama, all of Wako, Japan

[73] Assignee: Honda Giken Kogyo Kabushiki Kaisha, Tokyo, Japan

[21] Appl. No.: 937,379

[22] Filed: Sep. 25, 1997

[30] Foreign Application Priority Data

Sep. 26, 1996 [JP] Japan ..... 8-273962

[51] Int. Cl.[6] ..... F02D 41/14

[52] U.S. Cl. ..... 123/696; 701/109

[58] Field of Search ..... 123/674, 694, 123/696; 701/109

[56] References Cited

U.S. PATENT DOCUMENTS 5,724,952 3/1998 Miyashita et al. ..... 123/696 X
5,732,689 3/1998 Ohno et al. ..... 123/696 X

FOREIGN PATENT DOCUMENTS 6-146998 5/1994 Japan .
7-247889 9/1995 Japan .

OTHER PUBLICATIONS

"Combining Model Reference Adaptive Controllers and Stochastic Self–tuning Regulators", Landau, *Automatica*, vol. 18, No. 1, 1982, pp. 77–84.

"A Survey of Model Reference Adaptive Techniques–Theory and Applications", Landau, *Automatica*, vol. 10, 1974, pp. 353–379.

"Unification of Discrete Time Explicit Model Reference Adaptive Control Designs", Landau et al, *Automatica*, vol. 17, No. 4, 1981, pp. 593–611.

*Computrol*, No. 27, Corona Publishing Co., Ltd., pp. 28–41, 1989.

*Automatic Control Handbook*, OHM Ltd., pp. 703–707, 1983.

*Primary Examiner*—Tony M. Argenbright
*Attorney, Agent, or Firm*—Nikaido, Marmelstein, Murray & Oram LLP

[57] ABSTRACT

An air-fuel ratio control system for an internal combustion engine includes an air-fuel ratio sensor arranged in the exhaust system, for detecting the air-fuel ratio of exhaust gases from the engine. An ECU calculates an air-fuel ratio control amount, based on the output from the air-fuel ratio sensor, by using an adaptive controller having an adaptive parameter-adjusting mechanism for adjusting adaptive parameters, such that the air-fuel ratio of a mixture supplied to the engine is converged to a desired air-fuel ratio, and controls the air-fuel ratio of the mixture in a feedback manner, according to the calculated air-fuel ratio control amount. The adaptive parameter-adjusting mechanism calculates a parameter corresponding to an integral term of the air-fuel ratio control amount, and limit-checks a value of the parameter corresponding to the integral term so as to fall within a predetermined limit range.

3 Claims, 18 Drawing Sheets

ECU5
60
15
20
19
16
18
O2
23
17
LAF
22
1
14
IG
5
ECU
TW
13
12
ECU5
11
10
PBA
9
3
4
θTH
7
6
2
TA
8
PA
21
SPN
70

NE
PBA
θTH
PA
B1
TIMF
B2
B3
B4
B9
KTOTAL
TOUT
1
ENG
19
CAT
20
CAT
17
LAF
18
O2
22
LPF
23
LPF
B16
LPF
B17
SMOOTHING
B18
PID
B19
STR
B20
SW
B24
SMOOTHING
B21
KCMD
B22
MIDO2 FB
B23
KCMDM
KCMD
KLAF
KSTR
KFB
KCMDM
KCMD

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which carries out feedback control of the air-fuel ratio of a mixture supplied to the engine, by applying an adaptive control theory thereto.

2. Prior Art

Conventionally, an air-fuel ratio control system for internal combustion engines is known, e.g. from Japanese Laid-Open Patent Publication (Kokai) No. 7-247886, which calculates an air-fuel ratio control amount by using an adaptive controller including a parameter-adjusting mechanism of a recurrence formula type based on an adaptive control theory, and carries out feedback control of the air-fuel ratio of a mixture supplied to the engine, based on the calculated air-fuel ratio control amount. In the known air-fuel ratio control system, an air-fuel ratio sensor arranged in the exhaust system of the engine detects the air-fuel ratio and supplies an output indicative of the detected air-fuel ratio to the adaptive controller, which carries out the air-fuel ratio feedback control in response to the detected air-fuel ratio.

On the other hand, so-called PID control is widely employed to calculate an air-fuel ratio control amount in response to the output from the air-fuel ratio sensor, to thereby feedback-control the air-fuel ratio of the mixture supplied to the engine. When the air-fuel ratio control amount thus calculated falls outside a range defined by predetermined upper and lower limit values due to a disturbance during execution of the air-fuel ratio feedback control, limit-checking of the air-fuel ratio control amount and its integral term is executed to hold the air-fuel ratio control amount at the predetermined upper and lower limit values and the integral term at predetermined upper and lower limit values, to avoid sharp fluctuations in the air-fuel ratio.

When such limit-checking is executed during the air-fuel ratio control using the adaptive controller, however, the integral term cannot be separated from the equation for calculating the air-fuel ratio control amount, in a simple manner, for limit-checking thereof. Therefore, for example, as shown in FIG. 1, when a large disturbance temporarily takes place during execution of the air-fuel ratio control over a time period between time points t1 and t2, the air-fuel ratio control amount KSTR per se can be limit-checked and held at a limit value thereof at and after a time point t3, but the integral term cannot be limit-checked. As a result, even after the disturbance blows out, the air-fuel ratio control amount KSTR is held at the limit value over a considerable time period, and therefore the KSTR value returns to a state assumed before the appearance of the disturbance only after the considerable time period has elapsed. This inconvenience is caused by the fact that parameters corresponding to the integral term of the air-fuel ratio control amount KSTR continue to increase until a time point t2 at which the disturbance blows out, as indicated by the solid line in FIG. 1.

SUMMARY OF THE INVENTION

It is the object of the invention to provide an air-fuel ratio control system for internal combustion engines, which is capable of performing limit-checking not only of the air-fuel ratio control amount but also parameters corresponding to the integral term thereof during air-fuel ratio control using the adaptive controller, thereby reducing the influence of a large disturbance temporarily taking place during execution of the air-fuel ratio control and improving the convergence of the control after disappearance of the disturbance.

To attain the above object, the present invention provides an air-fuel ratio control system for an internal combustion engine having an exhaust system, including air-fuel ratio-detecting means arranged in the exhaust system, for detecting an air-fuel ratio of exhaust gases from the engine, and feedback control means for calculating an air-fuel ratio control amount, based on an output from the air-fuel ratio-detecting means, by using an adaptive controller having adaptive parameter-adjusting means for adjusting adaptive parameters, such that an air-fuel ratio of a mixture supplied to the engine is converged to a desired air-fuel ratio, and controlling the air-fuel ratio of the mixture supplied to the engine in a feedback manner, according to the air-fuel ratio control amount, the air-fuel ratio control system being characterized by an improvement wherein:

the adaptive parameter-adjusting means comprises integral term-corresponding parameter-calculating means for calculating a parameter corresponding to an integral term of the air-fuel ratio control amount, and limit-checking means for limit-checking a value of the parameter corresponding to the integral term so as to fall within a predetermined limit range.

In a preferred embodiment of the invention, the air-fuel ratio control amount (KSTR) is obtained by dividing a value obtained by subtracting from a difference (DKACT) between the desired air-fuel ratio (KCMD) and a product of an actual air-fuel ratio (KACT) and a first adaptive parameter (s0) products of a plurality of preceding values (KSTR(k-4), KSTR(k-8), KSTR(k-12)) and a plurality of respective second adaptive parameters (r1, r2, r3), by a third adaptive parameter (b0), the air-fuel ratio control amount (KSTR) being expressed by a formula including a proportional term ($-s0 \times DKACT/b0$) consisting of the difference (DKACT) and the first and third adaptive parameters (s0 and b0), by approximating the preceding values (KSTR(k-4), KSTR(k-8), KSTR(k-12)) to a predetermined value KSTR0, the parameter (KSTRCHK) corresponding to the integral term being a term ($\{1-s0-(r1+r2+r3) \times KSTR0\}/b0$) in the formula other than the proportional term.

Preferably, the limit-checking means holds the adaptive parameters at respective preceding values thereof when the parameter corresponding to the integral term falls outside the predetermined limit range.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
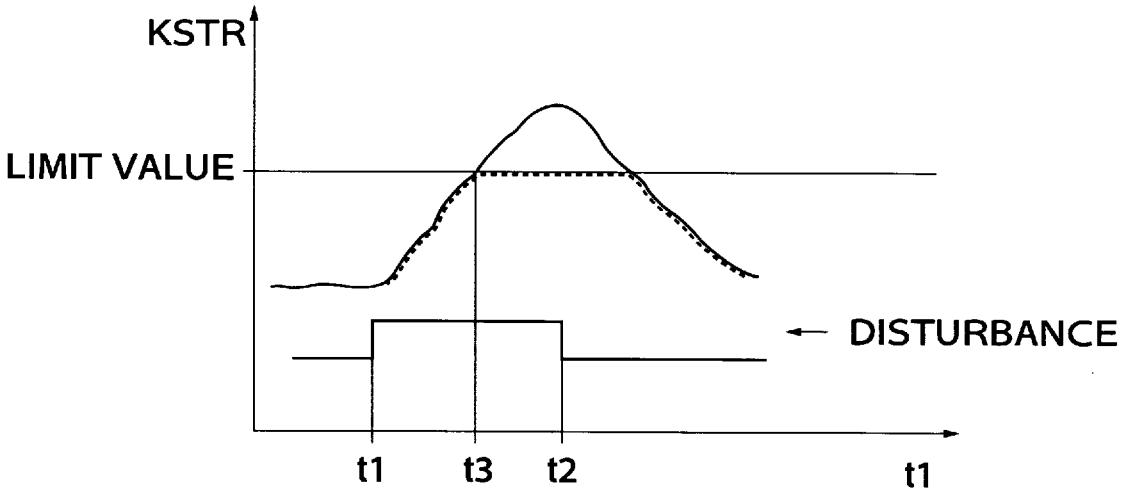
FIG.1 PRIOR ART
FIG. 1 is a graph useful in explaining a disadvantage with an air-fuel ratio control system according to the prior art.

Referring first to FIG. 1, there is schematically shown the whole arrangement of an internal combustion engine and a control system therefor, including an air-fuel ratio control system according to a first embodiment of the invention. In the figure, reference numeral 1 designates a four-cylinder type internal combustion engine (hereinafter simply referred to as "the engine").

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 as a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5 for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing, and for detecting the engine rotational speed NE.

Fuel injection valves 12 are inserted into the intake manifold 11 for respective cylinders at locations slightly upstream of intake valves, not shown. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θIG thereof controlled by signals therefrom.

An exhaust pipe 16 of the engine has a manifold part (exhaust manifold) 15 directly connected to the combustion chambers of the cylinders of the engine 1. A linear output oxygen concentration sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of exhaust gases from the engine changes across a stoichiometric air-fuel ratio to deliver a high level signal when the mixture is richer than the stoichiometric air-fuel ratio, and a low level signal when the mixture is leaner than the same. The O2 sensor 18 is electrically connected via a low-pass filter 23 to the ECU 5 for supplying the ECU 5 with the high or low level signal. The low-pass filters 22 and 23 are provided for eliminating high frequency noise components, and influence thereof on the responsiveness of the air-fuel ratio control system is negligible.

An automatic transmission, not shown, which is comprised of hydraulic clutches, etc. is interposed between the engine 1 and driving wheels, not shown, of a vehicle in which the engine 1 is installed. The automatic transmission can have a shift position thereof, including a P range, an N range, and a D range, changed through operation of a shift lever, not shown.

The automatic transmission is provided with a shift position (SPN) sensor 70 which detects the selected shift position of the automatic transmission and generates a signal indicative of the sensed shift position to the ECU 5.

Further electrically connected to the ECU 5 are vehicle wheel speed sensors, not shown, for sensing driving wheel speed and driven wheel speed of the vehicle, signals indicative of the sensed vehicle wheel speeds being supplied to the ECU 5. The ECU 5 determines an excessive slip state of the driving wheel(s), based on the sensed driving wheel speed and driven wheel speed. When an excessive slip state is detected, the ECU 5 carries out traction control which includes leaning the air-fuel ratio, interrupting fuel supply to part of the cylinders of the engine, and/or retarding the ignition timing of the engine.

The engine 1 includes a valve timing changeover mechanism 60 which changes valve timing of at least the intake valves out of the the intake valves and exhaust valves, not shown, between a high speed valve timing suitable for operation of the engine in a high speed operating region thereof and a low speed valve timing suitable for operation of the engine in a low speed operating region thereof. The changeover of the valve timing includes not only timing of opening and closing of the valve but also changeover of the valve lift amount, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21, for detecting atmospheric pressure PA, and supplying a signal indicative of the sensed atmospheric pressure PA to the ECU 5.

The ECU 5 is comprised of an input circuit having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps and tables, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT over which the fuel injection valves 12 are to be opened, by the use of the following equation (1), to output signals for driving the fuel injection valves 12, based on results of the calculation:

$$TOUT=TIMF\times KTOTAL\times KCMDM\times KFB \quad (1)$$

where TIMF represents a basic value of the fuel injection amount TOUT, KTOTAL a correction coefficient, KCMDM a final desired air-fuel ratio coefficient, and KFB a feedback correction coefficient, respectively.

Figure 3:
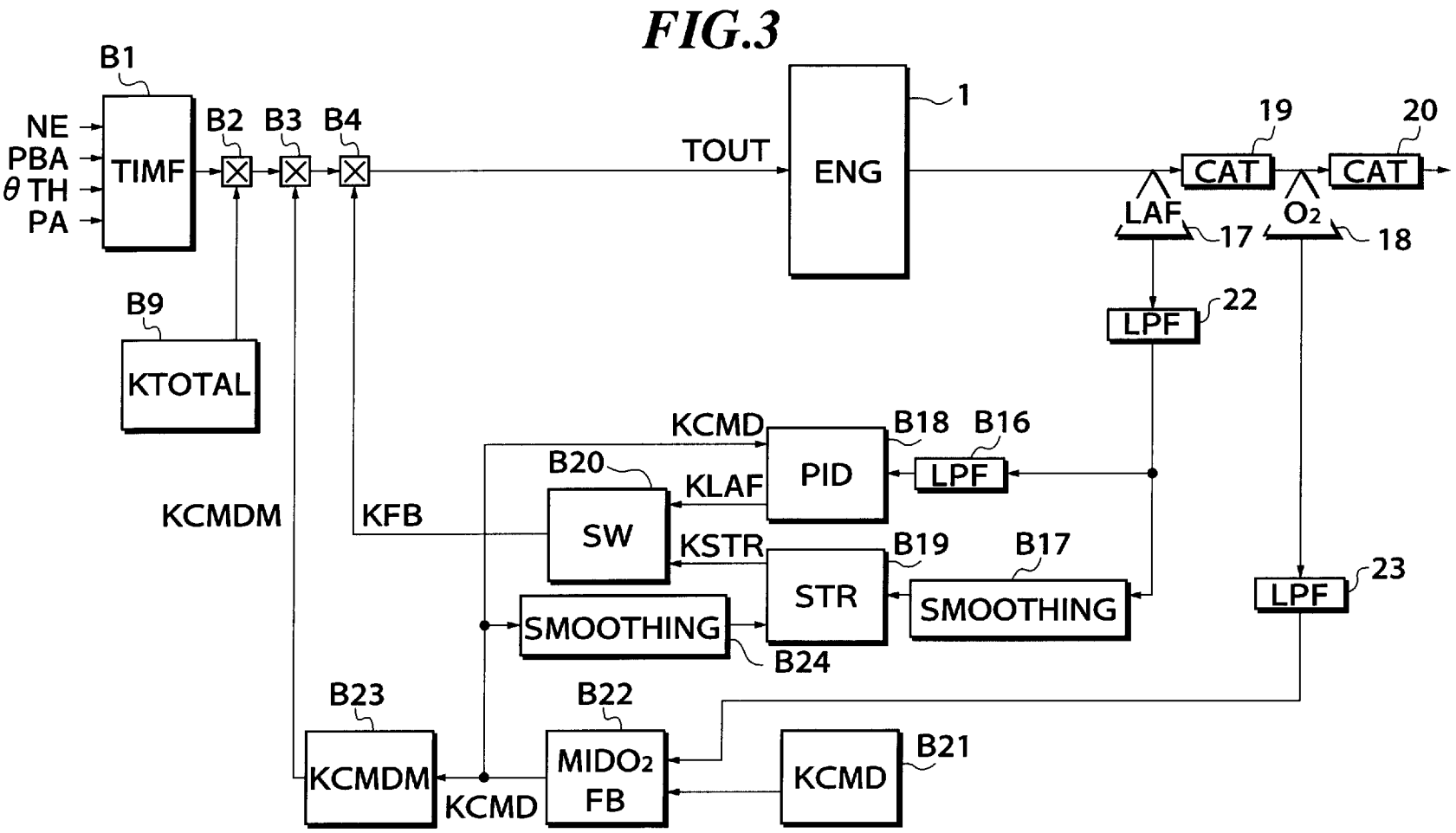
FIG. 3 is a block diagram useful in explaining a manner of controlling the air-fuel ratio of a mixture supplied to the engine.

FIG. 3 is a block diagram useful in explaining the manner of calculating the fuel injection period TOUT by the use of the equation (1). With reference to the figure, an outline of the manner of calculating the fuel injection period TOUT according to the present embodiment will be described. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 3, a block B1 calculates the basic fuel amount TIMF corresponding to an amount of intake air supplied to the engine 1. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B4 designate multiplying blocks, which multiply the basic fuel amount TIMF by respective parameter values input thereto, and deliver the product values. These blocks carry out the arithmetic operation of the equation (1), to thereby generate the fuel injection amount TOUT.

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purging-dependent correction coefficient KPUG set according to an amount of purged evaporative fuel during execution of purging by an evaporative fuel-processing system of the engine, not shown, to obtain the correction coefficient KTOTAL, which is supplied to the block B2.

A block B21 determines a desired air-fuel ratio coefficient KCMD based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on an output VM02 from the O2 sensor 18 supplied via the low-pass filter 23, and delivers the corrected KCMD value to blocks B18, B23 and B24. The block B23 carries out fuel cooling-dependent correction of the corrected KCMD value to calculate the final desired air-fuel ratio coefficient KCMDM and supplies the same to the block B3. The block B24 carries out smoothing of the desired air-fuel ratio KCMD, and supplies the smoothed desired desired air-fuel ratio coefficient KCMD to a block B19.

The output from the LAF sensor 17 supplied via the low-pass filter 22 is input via a low-pass filter block B16 to the block B18, and also input via a block B17 to the block B19. The block B17 carries out smoothing of the air-fuel ratio detected by the LAF sensor 17.

The block B18 calculates a PID correction coefficient KLAF through PID control, based on the difference between the actual air-fuel ratio and the desired air-fuel ratio, and delivers the calculated KLAF value to a block B20. The block B19 calculates an adaptive control correction coefficient KSTR through adaptive control (Self-Tuning Regulation), based on the air-fuel ratio detected by the LAF sensor 17, and delivers the calculated KSTR value to the block B20. The reason for employing the adaptive control is as follows: If the basic fuel amount TIMF is merely multiplied by the desired air-fuel ratio coefficient KCMD (KCMDM), the resulting desired air-fuel ratio and hence the actual air-fuel ratio may become dull due to a response lag of the engine. The adaptive control is employed to dynamically compensate for the response lag of the engine to thereby improve the robustness of the air-fuel ratio control against external disturbances.

The block B20 selects either the PID correction coefficient KLAF or the adaptive control correction coefficient KSTR supplied thereto, depending upon operating conditions of the engine, and delivers the selected correction coefficient as the feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated through the ordinary PID control in response to the output from the LAF sensor 17, or the adaptive control correction coefficient KSTR calculated through the adaptive control is selectively applied as the correction coefficient KFB to the equation (1) to calculate the fuel injection amount TOUT. When the correction coefficient KSTR is applied, the responsiveness of the air-fuel ratio control to changes in the air-fuel ratio and the robustness of the same against external disturbances can be improved, and hence the purification rate of the catalysts can be improved to ensure good exhaust emission characteristics of the engine in various operating conditions of the engine.

Figure 2:
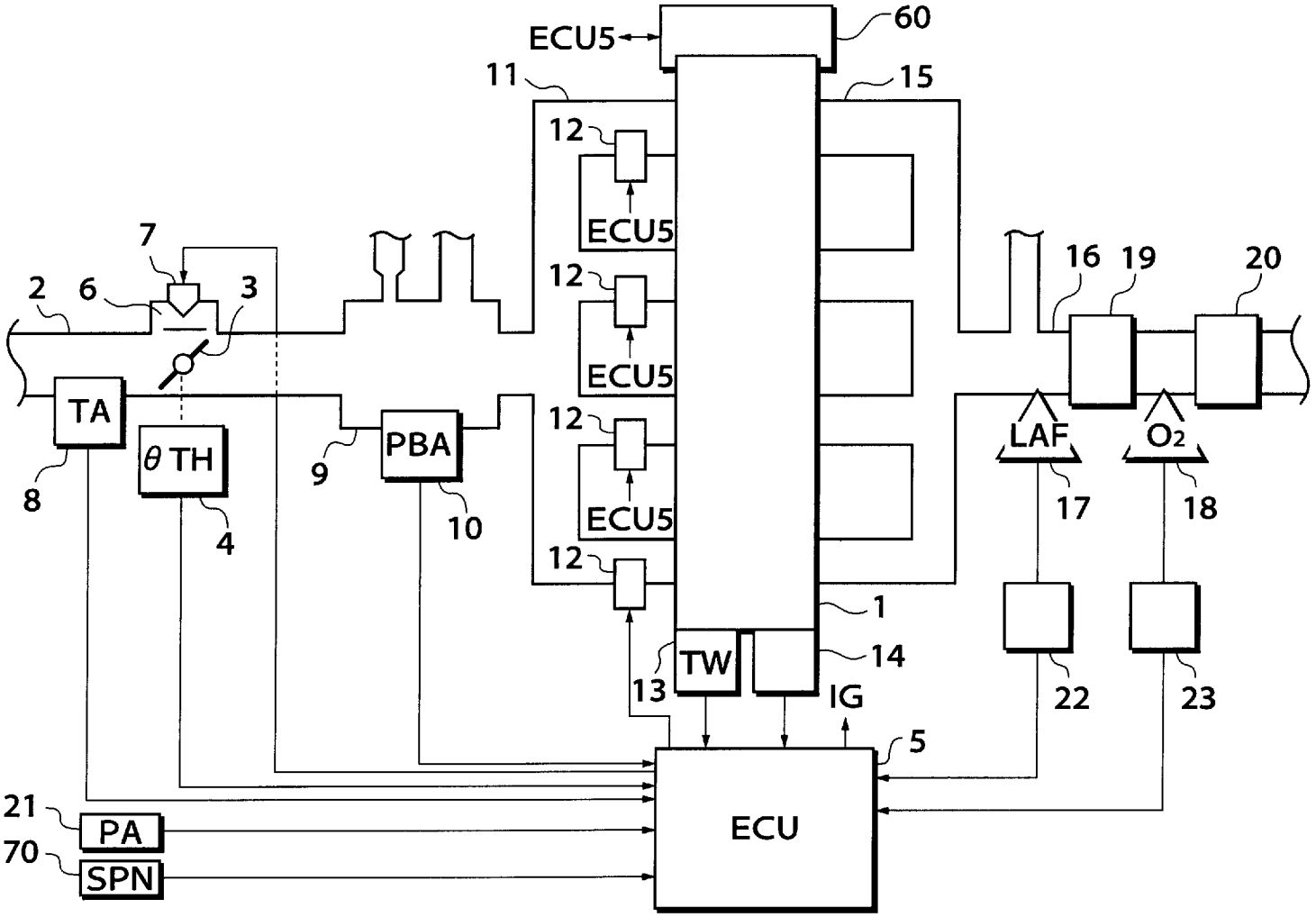
FIG. 2 is a block diagram showing the arrangement of an internal combustion engine and an air-fuel ratio control system therefor, according to an embodiment of the invention.

In the present embodiment, the functions of the blocks appearing in FIG. 2 are realized by arithmetic operations executed by the CPU of the ECU 5, and details of the operations will be described with reference to program routines illustrated in the drawings.

Figure 4:
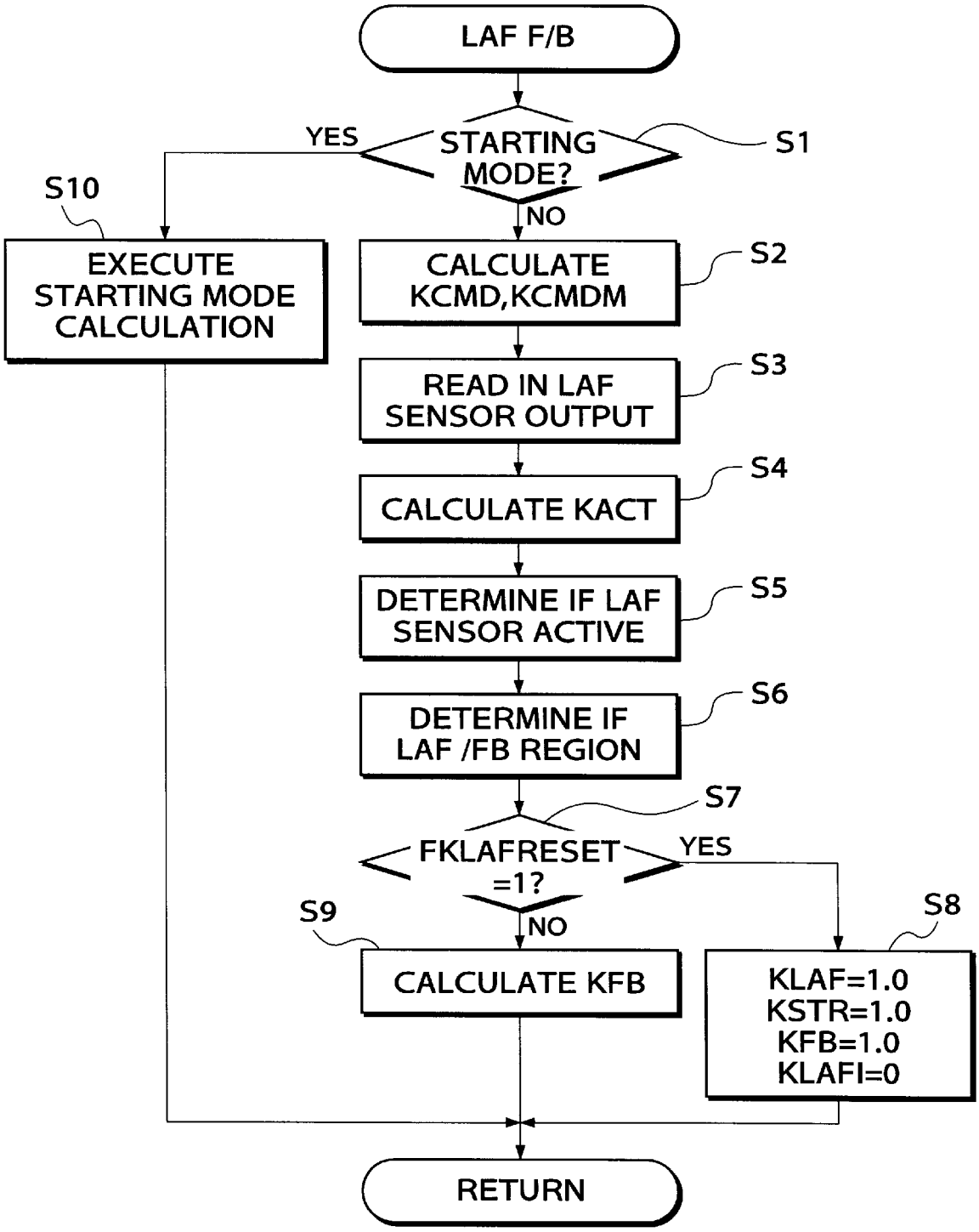
FIG. 4 is a flowchart showing a main routine for calculating a feedback correction coefficient KFB in response to an output from a LAF sensor appearing in FIG. 2.

FIG. 4 shows a main routine for calculating the PID correction coefficient KLAF and the adaptive control correction coefficient KSTR in response to the output from the LAF sensor 17, to thereby finally calculate the feedback correction coefficient KFB. This routine is executed in synchronism with generation of TDC signal pulses.

At a step S1, it is determined whether or not the engine is in starting mode, i.e. whether or not the engine is cranking. If the engine is in the starting mode, the program proceeds to a step S10 to execute a subroutine for the starting mode, not shown. If the engine is not in the starting mode, the desired air-fuel ratio coefficient (desired equivalent ratio) KCMD and the final desired air-fuel ratio coefficient KCMDM are calculated at a step S2, and a LAF sensor output-selecting process is executed at a step S3. Further, an actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined that the engine is not in the LAF feedback control region, a reset flag FKLAFRESET which, when set to "1", indicates that the engine is not in the LAF feedback control region, is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRSET=1 holds, the program proceeds to a step S8, wherein the PID correction coefficient KLAF, the adaptive control correction coefficient KSTR, and the feedback correction coefficient KFB are all set to "1.0", and an integral term KLAFI used in the PID control is set to "0", followed by terminating the program. On the other hand, if FKLAFRESET=0 holds, the feedback correction coefficient KFB is calculated at a step S9, followed by terminating the present routine.

Figure 5:
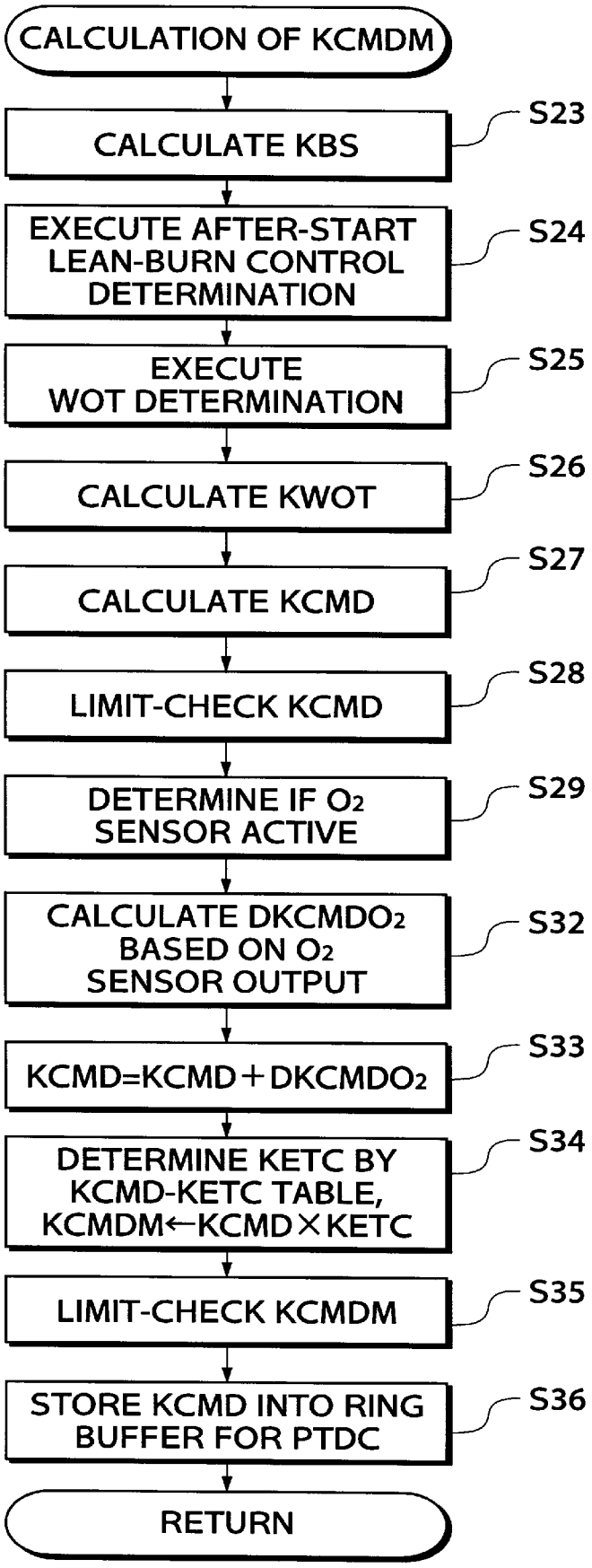
FIG. 5 is a flowchart showing a subroutine for calculating a final desired air-fuel ratio coefficient KCMDM, which is executed at a step S2 in FIG. 4.

FIG. 5 shows a subroutine for calculating the final desired air-fuel ratio correction coefficient KCMDM, which is executed at the step S2 in FIG. 4.

At a step S23, a basic value KBS is determined by retrieving a map according to the engine rotational speed NE and the intake pipe absolute pressure PBA. The map also contains values of the basic value KBS to be applied during idling of the engine.

At the following step S24, it is determined whether or not conditions for carrying out so-called after-start lean-burn control are fulfilled. If the conditions are fulfilled, an after-start leaning flag FASTLEAN is set to "1", whereas if they are not fulfilled, the flag FASTLEAN is set to "0". The conditions for the after-start lean-burn control are determined to be fulfilled when a predetermined time period has not elapsed after the start of the engine and at the same time the engine coolant temperature TW, the engine rotational speed NE and the intake pipe absolute pressure PBA are within respective predetermined ranges. The after-start lean-burn control is carried out for the purpose of preventing an increase in emission of HC occurring when the catalysts are inactive immediately after the start of the engine. In this connection, abnormality of pumping current flowing in the LAF sensor 17 may also be detected during execution of the lean-burn control.

Then, at a step S25, it is determined whether or not the throttle valve is fully open (i.e. the engine is in a WOT condition). If the throttle valve is fully open, a WOT flag FWOT is set to "1", whereas if the throttle valve is not fully open, the same flag is set to "0". Then, an enriching correction coefficient KWOT is calculated according to the engine coolant temperature TW at a step S26. At the same time, a correction coefficient KXWOT to be applied in a high coolant temperature condition is also calculated.

At the following step S27, the desired air-fuel ratio coefficient KCMD is calculated, and then limit-checking of the calculated KCMD value is carried out to limit the KCMD value to a range defined by predetermined upper and lower limit values at a step S28. A subroutine for executing the step S27 will be described in detail hereinafter with reference to FIG. 6.

At the following step S29, it is determined whether or not the O2 sensor 18 has been activated. If the O2 sensor 18 has been activated, an activation flag FMO2 is set to "1", whereas if the O2 sensor has not been activated, the same flag is set to "0". The O2 sensor 18 is determined to have been activated e.g. when a predetermined time period has elapsed after the start of the engine. At the following step S32, a correction term DKCMDO2 for correcting the desired air-fuel ratio coefficient KCMD is calculated according to the output VMO2 from the O2 sensor 18. More specifically, the correction term DKCMDO2 is calculated through the PID control according to the difference between the O2 sensor output VMO2 and a reference value VREFM.

Then, at a step S33, the desired air-fuel ratio coefficient KCMD is corrected by the use of the following equation (2):

$$KCMD=KCMD+DKCMDO2 \quad (2)$$

This correction makes it possible to set the desired air-fuel ratio coefficient KCMD such that a deviation of the LAF sensor output from a proper value is corrected.

At the following step S34, a KCMD-KETC table is retrieved according to the calculated KCMD value to determine a correction coefficient KETC, and the final desired air-fuel ratio coefficient KCMDM is calculated by the use of the following equation (3):

$$KCMDM=KCMD\times KETC \quad (3)$$

The correction coefficient KETC compensates for the influence of fuel cooling effects caused by fuel injection, the degree of which increases as the KCMD value increases to increase the fuel injection amount. The correction coefficient KETC is set to a larger value as the KCMD value is larger.

Then, limit-checking of the calculated KCMDM value is carried out at a step S35, and the KCMD value obtained at the step S33 is stored in a ring buffer memory at a step S36, followed by terminating the subroutine.

Figure 6:
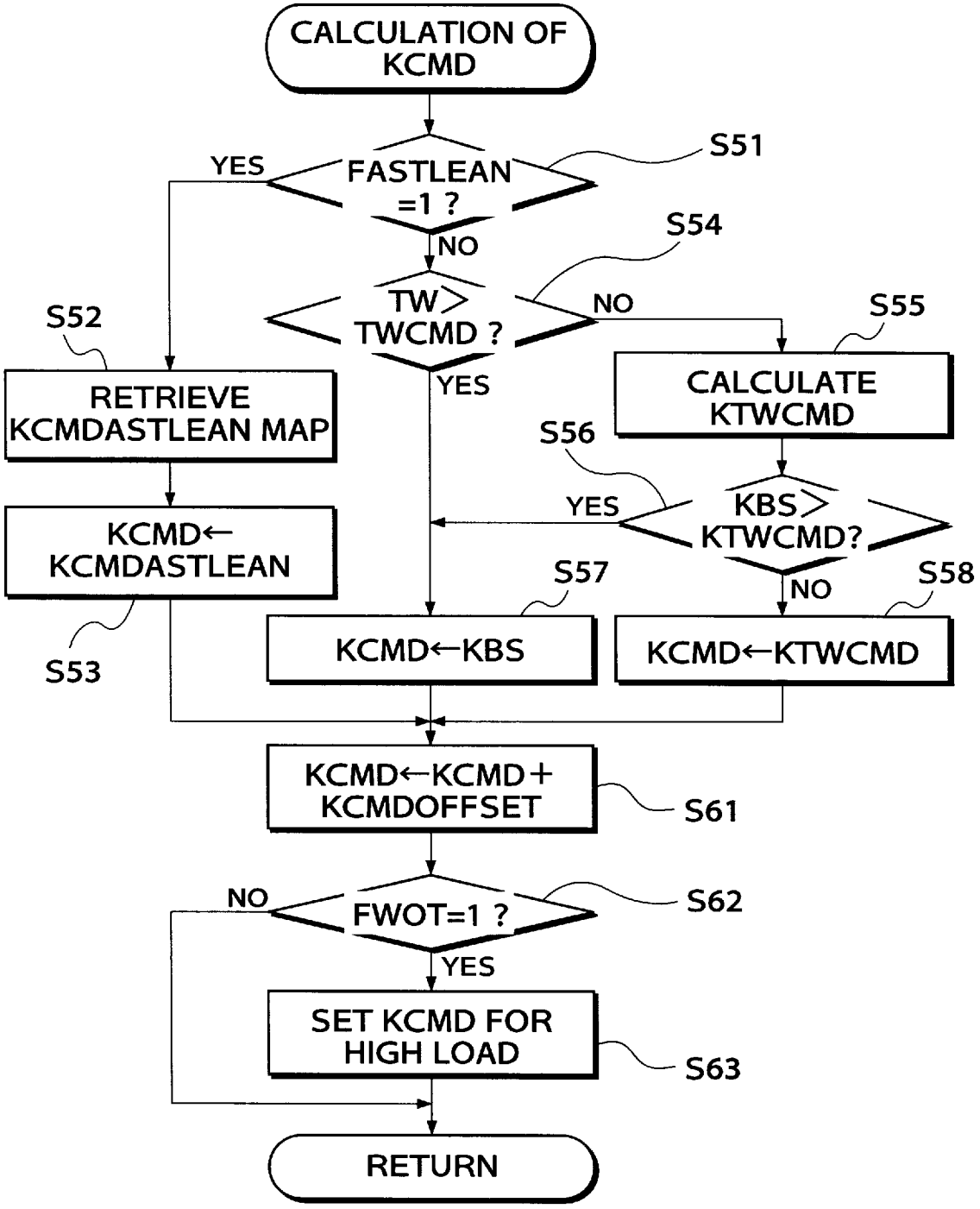
FIG. 6 is a flowchart showing a subroutine for calculating a desired air-fuel ratio coefficient KCMD, which is executed at a step S27 in FIG. 5.

FIG. 6 shows a subroutine for calculating the KCMD value, which is executed at the step S27 in FIG. 5.

First, at a step S51, it is determined whether or not the after-start leaning flag FASTLEAN which has been set at the step S24 in FIG. 5 is equal to "1". If FASTLEAN=1 holds, a KCMDASTLEAN map is retrieved to determine a leaning desired value KCMDASTLEAN which corresponds to a central air-fuel ratio suitable for the after-start lean-burn control, at a step S52. The KCMDASTLEAN map is set such that map values of the leaning desired value KCMDASTLEAN are set according to the engine coolant temperature TW and the intake pipe absolute pressure PBA. Then, at a step S53, the desired air-fuel ratio coefficient KCMD is set to the thus determined KCMDASTLEAN value, followed by the program proceeding to a step S61.

On the other hand, if FASTLEAN=0 holds at the step S51, which means that the conditions for executing the after-start lean-burn control are not satisfied, it is determined at a step S54 whether or not the engine coolant temperature TW is higher than a predetermined value TWCMD (e.g. 80° C.). If TW>TWCMD holds, the KCMD value is set to the basic value KBS calculated at the step S23 in FIG. 5, at a step S57, followed by the program proceeding to the step S61. If TW≦TWCMD holds, a map which is set according to the engine coolant temperature TW and the intake pipe absolute pressure PBA is retrieved to determine a desired value KTWCMD suitable for low coolant temperature at a step S55, and then it is determined at a step S56 whether or not the basic value KBS is larger than the determined KTWCMD value. If KBS>KTWCMD holds, the program proceeds to the step S57, whereas if KBS≦KTWCMD holds, the KCMD value is replaced by the determined desired value KTWCMD suitable for low coolant temperature at a step S58, followed by the program proceeding to the step S61.

At the step S61, the KCMD value is corrected by the use of the following equation (4), followed by the program proceeding to a step S62:

$$KCMD=KCMD+KCMDOFFSET \quad (4)$$

The addend correction term KCMDOFFSET is for finely adjusting the desired air-fuel ratio coefficient KCMD so as to compensate for variations in characteristics of the exhaust system of the engine and the LAF sensor, as well as changes in the exhaust system and the LAF sensor due to aging such that the actual air-fuel ratio assumes an optimum value for window zones of the three-way catalysts. The addend correction term KCMDOFFSET is set based on the characteristics of the LAF sensor 17, etc. Desirably, the KCMDOFFSET value is a learned value obtained by learning based on the output from the O2 sensor 18, etc.

At a step S62, it is determined whether or not the WOT flag FWOT which has been set at the step S25 in FIG. 5 is equal to "1". If FWOT=0 holds, the program is immediately terminated, whereas if FWOT=1 holds, the desired air-fuel ratio correction coefficient KCMD is set to a value suitable for a high-load condition of the engine at a step S63, followed by terminating the present program. The step S63 is executed more specifically by comparing the KCMD value with the enriching correction coefficients KWOT and KXWOT for the high-load condition of the engine calculated at the step S26 in FIG. 5, and if the KCMD value is smaller than these values, the KCMD value is multiplied by the correction coefficient KWOT or KXWOT for correction of the same.

Figure 7:
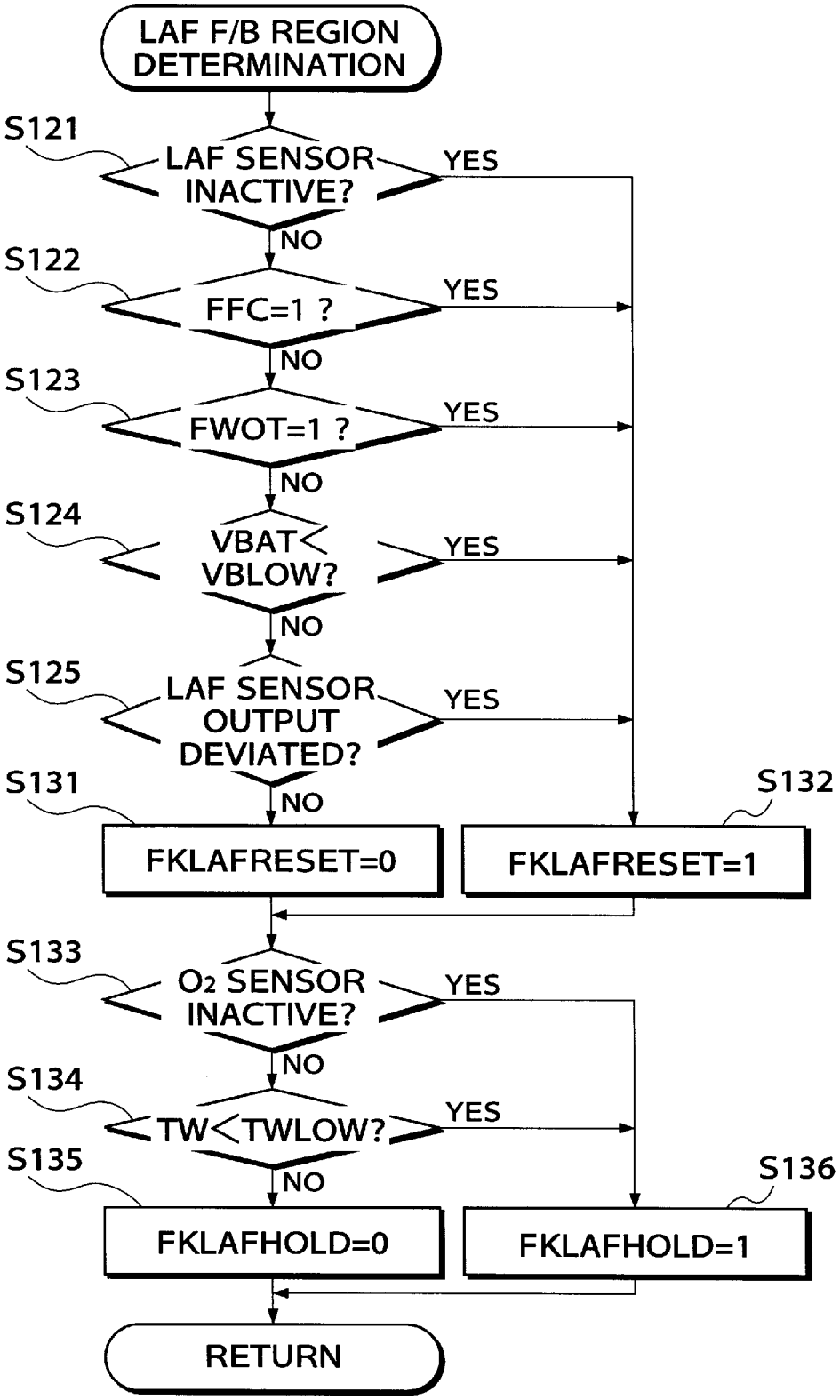
FIG. 7 is a flowchart showing a subroutine for carrying out a LAF feedback control region-determining process, which is executed at a step S6 in FIG. 4.

FIG. 7 shows a subroutine for carrying out a LAF feedback control region-determining process, which is executed at the step S6 in FIG. 4.

First, at a step S121, it is determined whether or not the LAF sensor 17 is in an inactive state. If the LAF sensor 17 is in the inactive state, it is determined at a step S122 whether or not a flag FFC which, when set to "1", indicates that fuel cut is being carried out, assumes "1". If FFC=0 holds, it is determined at a step S123 whether or not the WOT flag FWOT which, when set to "1", indicates that the engine is operating in the wide open throttle condition, assumes "1". If FWOT=1 does not hold, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the reset flag FKLAFRESET which, when set to "1", indicates that the feedback control based on the LAF sensor output should be terminated, is set to "1" at a step S132.

On the other hand, if all the answers to the questions of the steps S121 to S125 are negative (NO), it is determined that the feedback control based on the LAF sensor output can be carried out, and therefore the reset flag FKLAFRESET is set to "0" at a step S131.

At the following step S133, it is determined whether or not the O2 sensor 18 is an inactive state. If the O2 sensor 18 is in the active state, it is determined at a step S134 whether or not the engine coolant temperature TW is lower than a predetermined lower limit value TWLOW (e.g. 0° C.). If the O2 sensor 18 is in the inactive state or if TW<TWLOW holds, a hold flag FKLAFHOLD which, when set to "1", indicates that the PID correction coefficient KLAF should be held at the present value, is set to "1" at a step S136, followed by terminating the program. If the O2 sensor 18 has been activated and at the same time TW≧TWLOW holds, the hold flag FKLAFHOLD is set to "0" at a step S135, followed by terminating the program.

Next, a subroutine for executing the step S9 in the FIG. 4 main routine to calculate the feedback correction coefficient KFB will be described.

The feedback correction coefficient KFB is set to the PID correction coefficient KLAF or to the adaptive control correction coefficient KSTR depending upon operating conditions of the engine. First, manners of calculating these correction coefficients will be described with reference to FIGS. 8 and 9.

Figure 8:
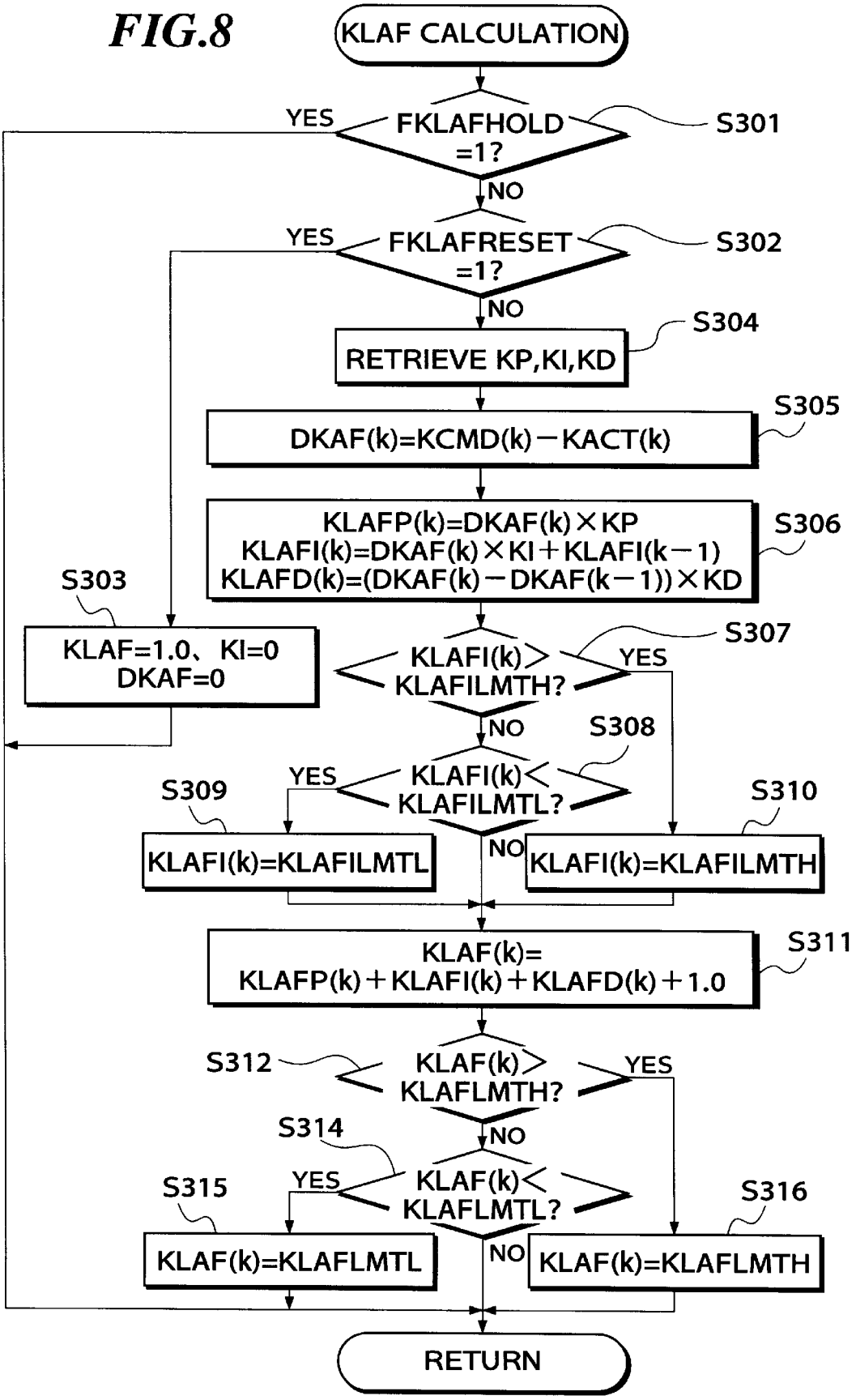
FIG. 8 is a flowchart showing a subroutine for calculating a PID correction coefficient KLAF, which is executed at a step S9 in FIG. 4.

FIG. 8 shows a subroutine for calculating the PID correction coefficient KLAF.

First, at a step S301, it is determined whether or not the hold flag FKLAFHOLD assumes "1". If FKLAFHOLD=1 holds, the present program is immediately terminated, whereas if FKLAFHOLD=0 holds, it is determined at a step S302 whether or not the reset flag FKLAFRESET assumes "1". If FKLAFRESET=1 holds, the program proceeds to a step S303, wherein the PID correction coefficient KLAF is set to "1.0" and at the same time an integral term control gain KI and the difference DKAF between the desired equivalent ratio KCMD and the actual equivalent ratio KACT are both set to "0", followed by terminating the present routine.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, a difference DKAF(k) (=KCMD(k)−KACT(k)) between the desired equivalent ratio KCMD and the actual equivalent ratio KACT is calculated at a step S305, and the difference DKAF(k) and the gains KP, KI, and KD are applied to the following equations (19) to (21) to calculate a proportional term KLAFP(k), an integral term KLAFI(k), and a differential term KLAFD(k) at a step S306:

$$KLAFP(k)=DKAF(k)\times KP \tag{5}$$

$$KLAFI(k)=DKAF(k)\times KI+KLAFI(k-1) \tag{6}$$

$$KLAFD(k)=(DKAF(k)-DKAF(k-1))\times KD \tag{7}$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at the steps S307 and S308, respectively. If KLAFI(k)>KLAFILMTH holds, the integral term KLAFI(k) is set to the predetermined upper limit value KLAFILMTH at a step S310, whereas if FLAFI(k)<KLAFILMTL holds, the same is set to the predetermined lower limit value KLAFILMTL at the step S309.

At the following step S311, the PID correction coefficient KLAF(k) is calculated by the use of the following equation (8):

$$KLAF(k)=KLAFP(k)+KLAFI(k)+KLAFD(k)+1.0 \tag{8}$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k)≦KLAFLMTH holds at the step S312, it is determined at a step S314 whether or not the KLAF(k) value is smaller than a predetermined lower limit value KLAFLMTL. If KLAF(k)≧KLAFLMTL holds, the present program is immediately terminated, whereas if KLAF(k)<KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Next, description will be made of calculation of the adaptive control correction coefficient KSTR with reference to FIG. 9.

Figure 9:
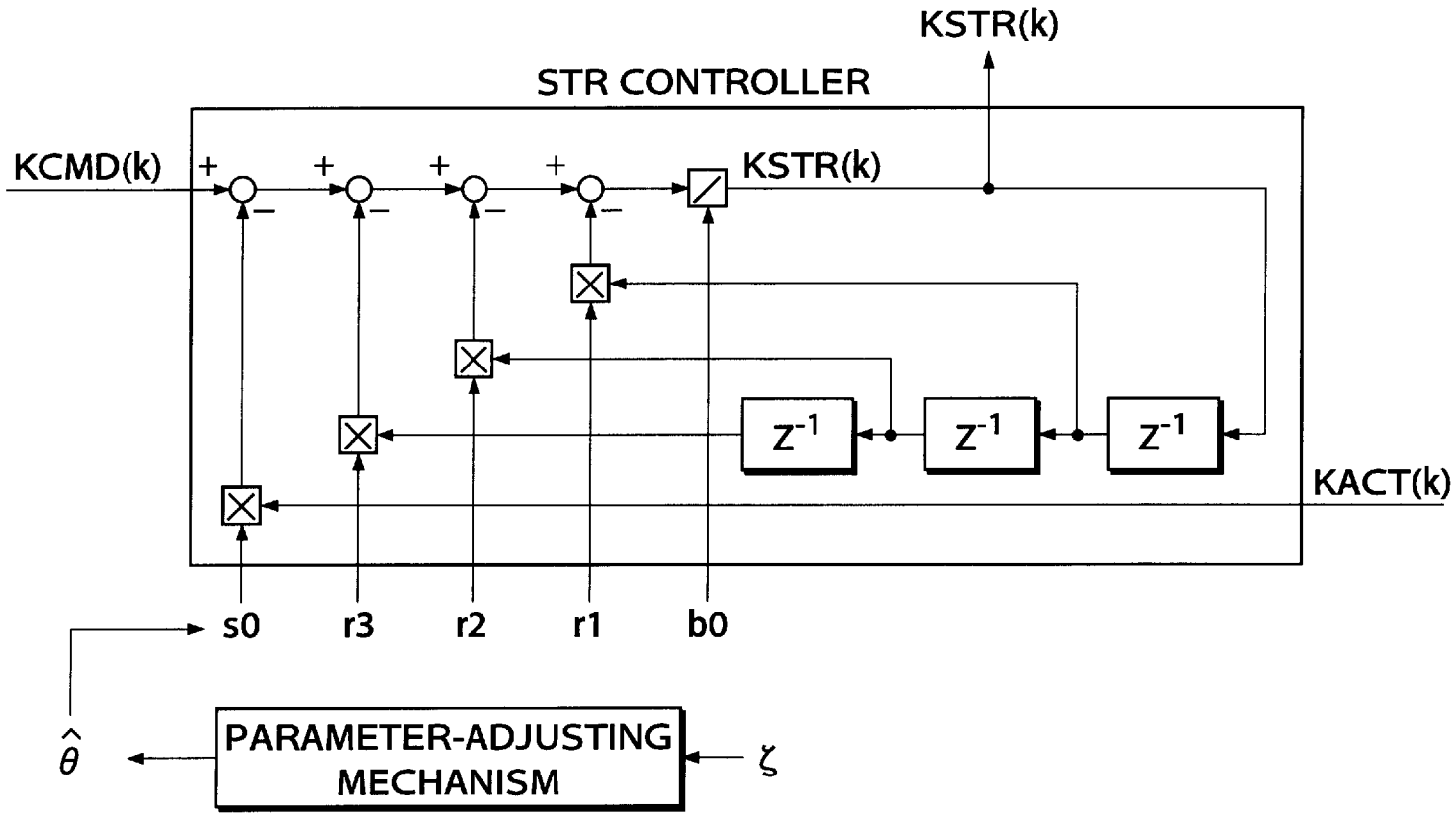
FIG. 9 is a block diagram useful in explaining a manner of calculating an adaptive control correction coefficient KSTR.

FIG. 9 shows the construction of the block B19 in FIG. 3, i.e. the self-tuning regulator (hereinafter referred to as "the STR") block. The STR block is comprised of a STR controller for setting the adaptive control correction coefficient KSTR such that the actual equivalent ratio KACT(k) becomes equal to the desired air-fuel ratio coefficient (desired equivalent ratio) KCMD(k), and a parameter adjusting mechanism for setting parameters to be used by the STR controller.

Adjustment laws (mechanisms) for adaptive control employed in the present embodiment include a parameter adjustment law proposed by Landau et al. According to this law, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This method is known and described e.g. in "Computrole" No. 27, CORONA PUBLISHING CO., LTD., Japan, pp. 28–41, "Automatic control handbook" OHM, LTD., Japan, pp. 703–707, "A Survey of Model Reference Adaptive Techniques—Theory and Application", I. D. LANDAU "Automatica" Vol. 10, pp. 353–379, 1974, "Unification of Discrete Time Explicit Model Reference Adaptive Control Designs", I. D. LANDAU et al. "Automatica" Vol. 17, No. 4, pp. 593–611, 1981, and "Combining Model Reference Adaptive Controllers and Stochastic Self-tuning Regulators", I. D. LANDAU "Automatica" Vol. 18, No. 1., pp. 77–84, 1982.

In the present embodiment, the above parameter adjustment law proposed by Landau et al. is employed. This parameter adjustment law will be described in detail, hereinbelow: According to this adjustment law, if polynomials of the denominator and numerator of the transfer function $A(Z^{-1})/B(Z^{-1})$ of the object of control by a discrete system are expressed by the following equations (9) and (10), the adaptive parameter $\theta^T(k)$ and the input $\zeta^T(k)$ to the adaptive parameter adjusting mechanism are defined by the following equations (11) and (12). The equations (11) to (12) define an example of a plant in which m=1, n=1 and d=3 hold, i.e. a system of the first order thereof has an ineffective time as long as three control cycles. The symbol k used herein indicates that the parameter with (k) has the present value, one with (k−1) the immediately preceding value, and so forth. u(k) and y(k) in the equation (12) correspond to the KSTR(k) and KACT(k) values, respectively, in the present embodiment.

$$A(z^{-1}) = 1 + a_1 z^{-1} + \ldots + a_n z^{-n} \tag{9}$$

$$B(z^{-1}) = b_0 + b_1 z^{-1} + \ldots + b_m z^{-m} \tag{10}$$

$$\begin{aligned} \hat{\theta}^T(k) &= [b_0(k), r_1(k), \ldots r_{m+d-1}(k), S_0(k), \ldots, S_{n-1}(k)] \\ &= [b_0(k), r_1(k), r_2(k), r_3(k), s_0(k)] \end{aligned} \tag{11}$$

$$\begin{aligned} \zeta^T(k) &= [u(k), \ldots, u(k-m-d+1), y(k), \\ &\quad \ldots, y(k-n+1)] \\ &= [u(k), u(k-1), u(k-2), u(k-3), y(k)] \end{aligned} \tag{12}$$

The adaptive parameter $\hat{\theta}(k)$ is expressed by the following equation (13):

$$\hat{\theta}(k) = \hat{\theta}(k-1) + \Gamma(k-1)\zeta(k-d)e^*(k) \tag{13}$$

where the symbols Γ(k) and e*(k) represent a gain matrix and an identification error signal, respectively, and can be expressed by the following recurrence formulas (14) and (15):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k) + \lambda_2(k)\zeta^T(k-d)\Gamma(k-1)\zeta(k-d)}\right] \tag{14}$$

$$e^*(k) = \frac{D(z^{-1})y(k) - \theta^T(k-1)\zeta(k-d)}{1 + \zeta^T(k-d)\Gamma(k-1)\zeta(k-d)} \tag{15}$$

Further, it is possible to provide various specific algorithms depending upon set values of λ1(k) and λ2(k). For example, if λ1(k)=1 and λ2(k)=λ(0<λ1<2) hold, a progressively decreasing gain algorithm is provided (if λ=1, the least square method), if λ1(k)=λ1 (0<λ1<1) and λ2(k)=λ2 (0<λ2<2) hold, a variable gain algorithm (if λ2=1, the method of weighted least squares), and if λ1(k)/λ2(k)=σ and if λ3 is expressed by the following equation (16), λ1(k)=λ3 provides a fixed trace algorithm. Further, if λ1(k)=1 and λ2(k)=0 hold, a fixed gain algorithm is obtained. In this case, as is clear from the equation (14), Γ(k)=Γ(k−1) holds, and hence Γ(k)=Γ(fixed value) is obtained.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \tag{16}$$

In the example of FIG. 9, the STR controller (adaptive controller) and the adaptive parameter adjusting mechanism are arranged outside the fuel injection amount-calculating system, and operate to calculate the feedback correction coefficient KSTR(k) such that the actual equivalent ratio KACT(k) becomes equal to the desired equivalent ratio KCMD(k−d') (d' represents an ineffective time period before the KCMD value reflects on the actual equivalent ratio KACT) in an adaptive manner.

In this manner, the adaptive control correction coefficient KSTR(k) and the actual equivalent ratio KACT#N(k) are determined, which are input to the adaptive parameter-adjusting mechanism, where the adaptive parameter $\hat{\theta}(k)$ is calculated to be input to the STR controller. The STR controller is also supplied with the desired equivalent ratio KCMD(k) and calculates the adaptive control correction coefficient KSTR(k) such that the actual equivalent ratio KACT(k) becomes equal to the desired equivalent ratio KCMD(k), by the use of the following recurrence formula (17):

$$KSTR(k) = \frac{KCMD(k-d') - s_0 \times KACT(k) - r_1 \times KSTR(k-1) - r_2 \times KSTR(k-2) - r_3 \times KSTR(k-3)}{b_0} \tag{17}$$

In the above description, the control cycle and the repetition period of calculation of the KSTR value (repetition period of generation of TDC signal pulses) are made to coincide with each other and the adaptive control correction coefficient KSTR thus calculated is commonly used for all the cylinders. The present embodiment, however, employs the control cycle made corresponding to the number of cylinders or four TDC signal pulses, whereby the adaptive control correction coefficient KSTR is determined cylinder by cylinder. More specifically, the above-mentioned formulas (12) to (17) are replaced by the following formulas (18) to (23), respectively, to determine the adaptive control correction coefficient KSTR cylinder by cylinder for use in the adaptive control:

$$\zeta^T(k) = [u(k), u(k-4), u(k-8), u(k-12), y(k)] \tag{18}$$

$$\hat{\theta}(k) = \hat{\theta}(k-4) + \Gamma(k-4)\zeta(k-4xd)e^*(k) \tag{19}$$

-continued $$\Gamma(k) = \frac{1}{\lambda_1(k)}\left[\Gamma(k-4) - \frac{\lambda_2(k)\Gamma(k-4)\zeta(k-4xd)\zeta^T(k-4xd)\Gamma(k-4)}{\lambda_1(k)+\lambda_2(k)\zeta^T(k-4xd)\Gamma(k-4)\zeta(k-4xd)}\right] \quad (20)$$

$$e^*(k) = \frac{D(z^{-1})y(k) - \hat{\theta}^T(k-4)\zeta(k-4xd)}{1+\zeta^T(k-4xd)\Gamma(k-4)\zeta(k-4xd)} \quad (21)$$

$$\lambda_3(k) = 1 - \frac{\|\Gamma(k-4)\zeta(k-4xd)\|^2}{\sigma+\zeta^T(k-4xd)\Gamma(k-4)\zeta(k-4xd)} \cdot \frac{1}{tr\Gamma(0)} \quad (22)$$

$$KSTR(k) = \{KCMD(k-4xd') - s_o \times KACT(k) - r_1 \times KSTR(k-4) - r_2 \times KSTR(k-8) - r_3 \times KSTR(k-12)\}/b_o \quad (23)$$

where d' in the above formula (23) represents e.g. "2".

Next, description will be made of a manner of calculating the feedback correction coefficient KFB by switching between the PID correction coefficient KLAF and the adaptive control correction coefficient KSTR, i.e. by switching between the PID control and the adaptive control.

Figure 10:
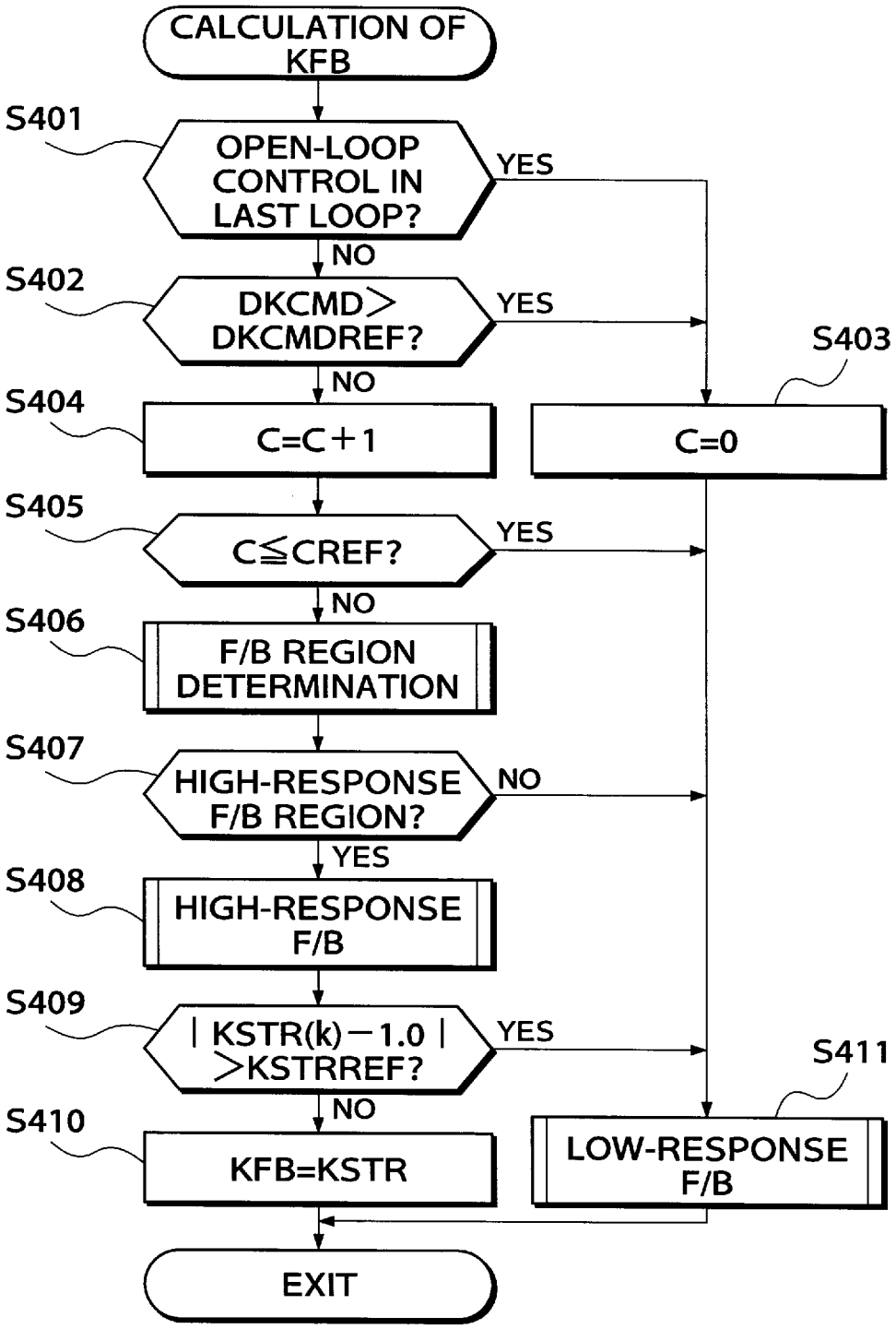
FIG. 10 is a flowchart showing a subroutine for calculating the feedback correction coefficient KFB, which is executed at the step S9 in FIG. 4.

FIG. 10 shows a subroutine for calculating the feedback correction coefficient KFB, which is executed at the step S9 in FIG. 4.

First, it is determined at a step S401 whether or not the control mode was an open-loop control mode in the last loop of execution of the FIG. 4 routine, i.e. whether or not FKLAFRESET=1 held. If the control mode was not the open-loop control mode, it is determined at a step S402 whether or not a rate of change DKCMD in the desired equivalent ratio KCMD (=|KCMD(k)−KCMD(k−1)|) is larger than a reference value DKCMDREF. If the control mode was the open-loop control mode in the last loop of execution of the FIG. 4 routine, or if the control mode was the feedback control mode in the last loop of execution of the FIG. 4 routine and at the same time the rate of change DKCMD is larger than the reference value DKCMDREF, it is judged that the engine is in a region where a low-response feedback control should be executed (hereinafter referred to as "the low-response F/B region"). Then, a counter C is reset to "0" at a step S403, followed by the program proceeding to a step S411. At the step S411, the low-response F/B control is executed, which will be described hereinafter with reference to FIG. 14, followed by terminating the program.

As noted above, the engine is determined to be in the low-response F/B region when the engine was in the open-loop region in the last loop because an air-fuel ratio value indicated by the LAF sensor output does not necessarily show a true or exact value of the air-fuel ratio due to a delay of detection by the LAF sensor, which will occur e.g. when the fuel supply is resumed after fuel cut, so that the air-fuel ratio feedback control can be unstable. For a similar reason, when the amount of change DKCMD in the desired equivalent ratio KCMD is large, which will occur e.g. when a WOT enriching operation is stopped to resume the normal air-fuel control, or when the air-fuel ratio control is switched over from the lean-burn control to the feedback control to the stoichiometric air-fuel ratio, the engine is determined to be in the low-response F/B region.

If the answers to the questions of the steps S401 and S402 are both negative (NO), i.e. if the control mode was the feedback control mode in the last loop and at the same time the rate of change DKCMD in the desired equivalent ratio KCMD is equal to or smaller than the reference value DKCMDREF, the count of the counter C is incremented by "1" at a step S404, and then the count of the counter C is compared with a predetermined value CREF (e.g. 5) at a step S405. If C≦CREF holds, the program proceeds to the step S411, whereas if C>CREF holds, the program proceeds to a step S406, wherein it is determined by executing a subroutine, described hereinafter, whether the engine is operating in a region in which a high-response feedback control should be executed (hereinafter referred to as "high-response F/B region") or in the low-response F/B region. Then, at a step S407, it is determined whether or not the control region in which the engine has been determined to be operating at the step S406 is the high-response F/B region. If the determined control region is not the high-response F/B region, the program proceeds to the step S411, whereas if the control region is the high-response F/B region, the program proceeds to a step S408, wherein a subroutine for the high-response feedback control, described hereinafter, is executed to calculate the adaptive control correction coefficient KSTR. Then, the feedback correction coefficient KFB is set to the KSTR value at a step S410, followed by terminating the program.

When the count of the counter C is smaller than the reference value CREF, the low-response feedback control is thus selected because immediately after returning of the engine operating condition from the open-loop control or immediately after a large variation in the desired equivalent ratio KCMD, a time lag before completion of the fuel combustion and a response lag of the LAF sensor are so large that influences thereof cannot be compensated for by the adaptive control.

Figure 11:
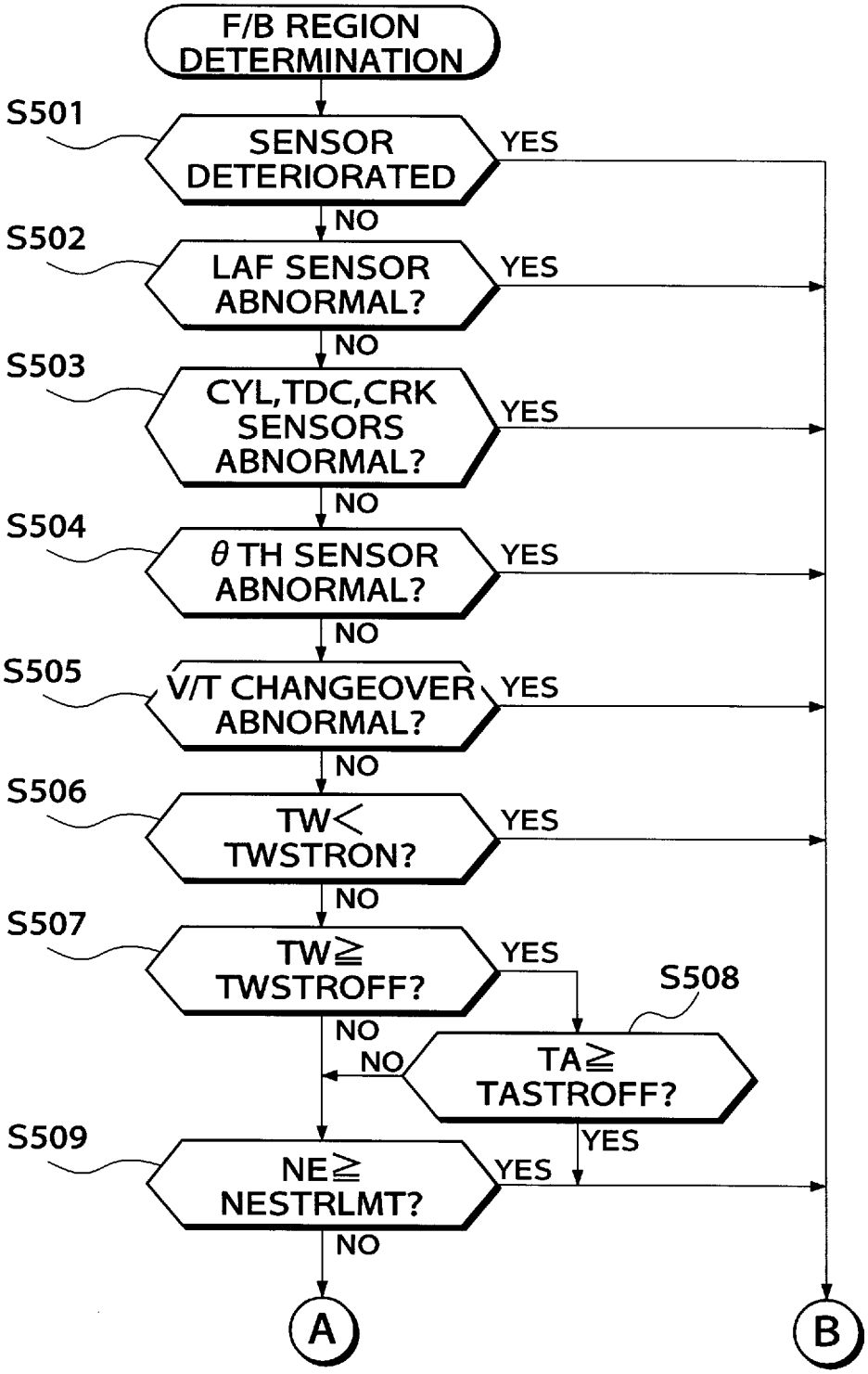
FIG. 11 is a flowchart showing a subroutine for selecting the response speed of the air-fuel ratio feedback control, which is executed at a step S406 in FIG. 10.
Figure 12:
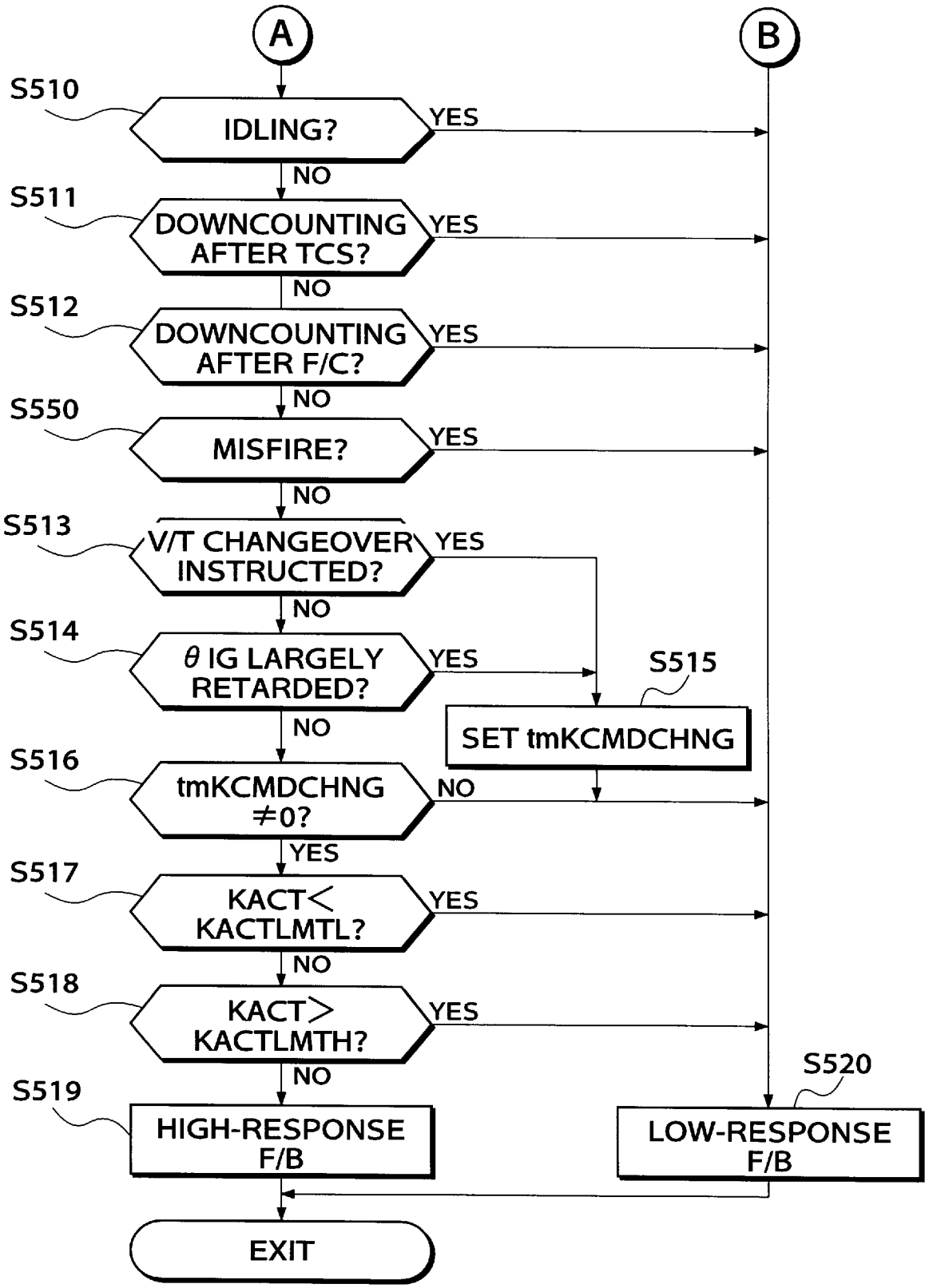
FIG. 12 is a continued part of the flowchart of the FIG. 11 subroutine.

Next, the subroutine executed at the step S406 in FIG. 10 for selecting the response speed of the air-fuel ratio feedback control, i.e. determining whether the engine is operating in the high-response F/B region or in the low-response F/B region will be described with reference to FIGS. 11 and 12.

First, at a step S501, it is determined whether or not the LAF sensor 17 is deteriorated in response characteristic. If the LAF sensor 17 is not deteriorated in response characteristic, the program proceeds to a step S502.

At the step S502, it is determined whether or not abnormality of the LAF sensor 17 has been detected. If no abnormality of the LAF sensor 17 has been detected, it is determined at a step S503 whether or not abnormality of the crank angle sensor 14 (cylinder-discriminating sensor, TDC sensor, or CRK sensor) has been detected. If no abnormality of the crank angle sensor has been detected, it is determined at a step S504 whether or not abnormality of the throttle valve opening θTH sensor 4 has been detected. If no abnormality of the throttle valve opening sensor 4 has been detected, it is determined at a step S505 whether or not abnormality of the valve timing changeover mechanism 60 has been detected.

If all the answers to the questions of the steps S501 to S505 are negative (NO), the program proceeds to a step S506, whereas if any of the answers is affirmative (YES), it is determined at a step S520 that the engine is in the low-response F/B region, followed by terminating the program.

The low-response feedback control is thus selected when any of the above-mentioned sensors is abnormal, so as to prevent degradation of the controllability of the air-fuel ratio.

Then, at the step S506, it is determined whether or not the engine coolant temperature TW is lower than a predetermined value TWSTRON. If TW≧TWSTRON holds, it is determined at a step S507 whether or not the engine coolant temperature TW is equal to or higher than a predetermined value TWSTROFF (e.g. 100° C.). If TW≧TWSTROFF holds, it is determined at a step S508 whether or not the intake air temperature TA is equal to or higher than a predetermined value TASTROFF. If TW<TWSTROFF holds at the step S507 or if TW≧TWSTROFF holds at the step S507 and at the same time TA<TASTROFF holds at the step S508, the program proceeds to a step S509, wherein it is determined whether or not the engine rotational speed NE is equal to or higher than a predetermined value NESTRLMT. If NE<NESTRLMT holds, it is determined at a step S510 whether or not the engine is idling. If the engine is not idling, it is determined at a step S511 whether or not a timer is in operation for measuring a time period elapsed after termination of traction control by the traction control system (TCS). This timer is formed by a down-counting timer, and set during TCS operation and started when the TCS operation is terminated.

If the timer is not in operation at the step S511, it is determined at a step S512 whether or not a timer is in operation for measuring a time period elapsed after termination of fuel cut. The fuel cut is carried out when the engine is in a predetermined decelerating condition, and the fuel cut flag FFC is set to "1" during the fuel cut operation. This timer is also formed by a down-counting timer, and set during the fuel cut operation and started upon termination of fuel cut.

If any of the answers to the questions of the steps S506 and S509 to S512 is affirmative (YES), or if both the answers to the questions of the steps S507 and S508 are affirmative (YES), it is determined at the step S520 that the engine is in the low-response F/B region, followed by terminating the program. If the answer to the question of the step S512 is negative (NO), the program proceeds to a step S550.

At the step S550, it is determined whether or not a misfire has occurred in the engine. A misfire can be determined to have occurred in the engine when the variation in the engine rotational speed NE is above a predetermined value, as disclosed in Japanese Laid-Open Patent Publication (Kokai) No. 6-146998 filed by the present assignee. When the engine suffers from a misfire, the program proceeds to the step S520, whereas when the engine does not suffer from a misfire, the program proceeds to a step S513.

At the step S513, it is determined whether or not changeover of the valve timing between the high-speed V/T and the low-speed V/T has been instructed. If the changeover has not been instructed, it is determined at a step S514 whether or not the ignition timing of the engine has been largely retarded. If the ignition timing has not been largely retarded, the program proceeds to a step S516. If either the answer to the question of the step S513 or the answer to the question of the step S514 is affirmative (YES), a down-counting timer tmKCMDCHNG is set to a predetermined time period TCHNG and started at a step S515, followed by the program proceeding to the step S520. The predetermined time period TCHNG is set to a time period sufficient for the combustion of the engine to become stable after the changeover of the valve timing has been instructed or after the ignition timing has been largely retarded.

At the step S516, it is determined whether or not the count of the down-counting timer tmKCMDCHNG is not equal to "0". If the count is not equal to "0", the program proceeds to the step S520, whereas if the count is equal to "0", it is determined at steps S517 and S518 whether or not the actual equivalent ratio KACT is within a predetermined range defined by a predetermined lower limit value KACTLMTL (e.g. 0.99) and a predetermined upper limit value KACTLMTH (e.g. 1.01). If KACT<KACTLMTL or KACT>KACTLMTH holds, the program proceeds to the step S520, whereas if KACTLMTL≦KACT≦KACTLMTH holds, the program proceeds to a step S519, wherein it is determined that the engine is in the high-response F/B region, followed by terminating the program.

By executing the steps S517 and S518, changeover of the feedback control from the low-response feedback control to the high-response feedback control is carried out only when the actual equivalent ratio KACT is equal to 1.0 or a value close thereto, to thereby achieve smooth changeover of the feedback control mode and hence ensure required stability of the fuel-ratio control. The reason why it is thus determined by the steps S506 to S516 that the low-response feedback control should be executed is as follows:

When the engine coolant temperature TW is low (TW <TWSTRON), the engine combustion is not stable due to insufficient atomization of fuel and increased friction between the piston and the cylinder, so that a misfire can occur. Therefore, a stable value of the detected equivalent ratio KACT cannot be obtained if the high-response feedback control is carried out in such a condition. Also when the engine coolant temperature TW is extremely high (TW≧TWSTROFF) and at the same time the intake air temperature is extremely high (TA≧ TASTROFF), vapor lock can occur in the fuel supply line to decrease the actual amount of fuel injection. When the engine rotational speed NE is high, i.e. if NE≧NESTRLMT holds, the ECU 5 can have an insufficient calculation time and further the engine combustion is not stable.

Further, when the engine is idling, the engine operating condition is almost stable such that the high-response feedback control, which has a high gain, is not required to be carried out. Immediately after termination of the traction control in which the ignition timing is temporarily largely retarded or fuel cut is effected to decrease the torque of the engine so as to avoid excessive slippage of the wheels, the engine combustion is not stable before a predetermined time period elapses after the termination of the traction control, so that execution of the high-response feedback control can unexpectedly result in an increase in the variation of the air-fuel ratio. For a similar reason, immediately after termination of a usual decelerating fuel cut operation, the low-response feedback control is selected. Similarly, when a misfire occurs in the engine, the engine combustion is undoubtedly unstable, so that the low-response feedback control is selected. Further, before the predetermined time period (TCHNG) elapses after changeover of the valve timing, the combustion state of the engine drastically changes due to a change in the valve opening period over which the intake or exhaust valves are opened. Also, before the predetermined time period TCHNG elapses after termination of control of ignition timing to a largely retarded timing, the engine combustion is not stable, and hence a stable KACT value cannot be expected.

In addition to the traction control, large retardation of the ignition timing may be carried out in execution of other kinds of control such as torque shock-reducing control executed when the automatic transmission undergoes a change in the shift gear position, knocking-avoiding control executed when load on the engine is high, ignition timing control executed for the purpose of accelerating the rise of the temperature of the catalysts immediately after the engine is started, or on like occasions.

Next, the high-response/low-response feedback control executed by the control system according to the present embodiment will be described.

Figure 13:
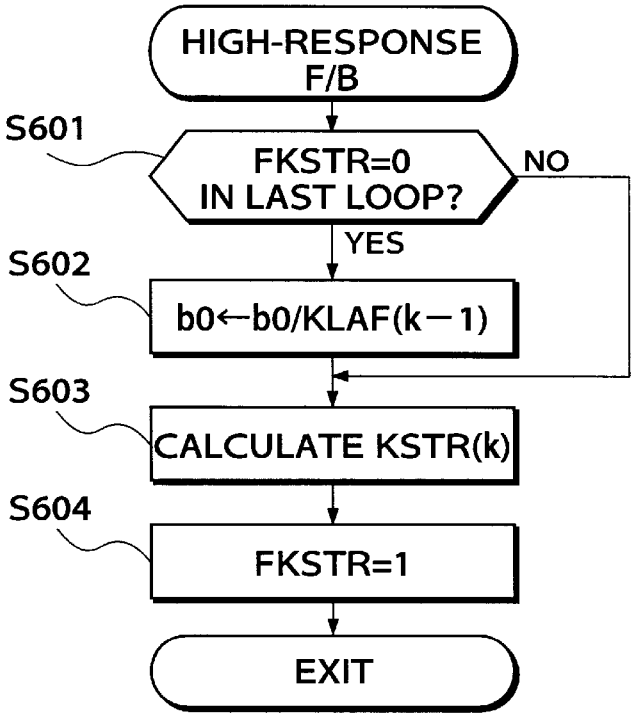
FIG. 13 is a flowchart showing a subroutine for carrying out a high-response air-fuel ratio feedback control, which is executed at a step S519 in FIG. 12.

FIG. 13 shows a subroutine for carrying out the high-response feedback control executed at the step S408 in FIG. 10. First, at a step S601, it is determined whether or not a flag FKSTR, which, when set to "1", indicates that the engine is operating in a region in which the feedback control by the use of the adaptive control correction coefficient KSTR should be executed (hereinafter referred to as "the adaptive control region"), assumed "0" in the immediately preceding loop. If the flag FKSTR assumed "1" in the last loop, the program jumps to a step S603, wherein the adaptive control correction coefficient KSTR is calculated in a manner described hereinafter with reference to FIG. 15, and then the flag FKSTR is set to "1" at a step S604, followed by terminating the program.

On the other hand, if the flag FKSTR assumed "0" in the last loop, the adaptive parameter b0 (scalar quantity determining the gain) is replaced by a value obtained by dividing the b0 value by the last value KLAF (k−1) of the PID correction coefficient KLAF at a step S602, followed by the program proceeding to the step S603.

By replacing the adaptive parameter b0 by the value b0/KLAF(k−1) at the step S602, further smooth changeover from the PID control to the adaptive control can be obtained to thereby ensure required stability of the control. The reason for carrying out the replacement is as follows: If the value b0 in the equation (23) is replaced by the value b0/KLAF(k−1), the following equation (24) is obtained, where the first term of the equation is equal to "1" because the adaptive control correction coefficient KSTR is set to and held at 1 (KSTR(k)=1) during execution of the PID control. Accordingly, the value KSTR(k) at the start of the adaptive control becomes equal to the value KLAF(k−1), resulting in smooth changeover of the correction coefficients:

$$\begin{aligned} KSTR(k) &= [\{KCMD(k-4xd') - s_0 \times KACT(k) - r_1 \times KSTR(k-4) - r_2 \times KSTR(k-8) - r_3 \times KSTR(k-12)\}/b_0] \times KLAF(k-1) \\ &= 1 \times KLAF(k-1) \\ &= KLAF(k-1) \end{aligned} \quad (24)$$

Figure 14:
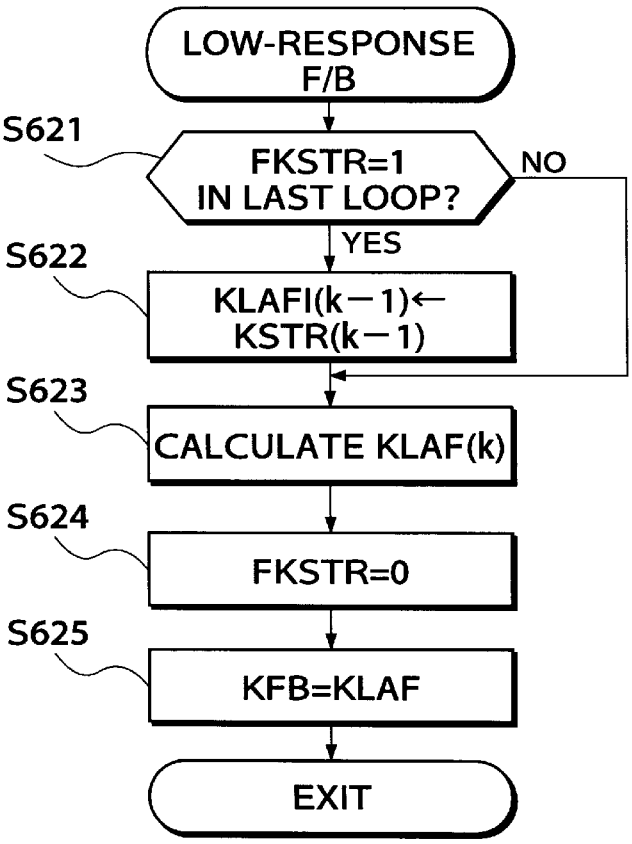
FIG. 14 is a flowchart showing a subroutine for carrying out a low-response air-fuel ratio feedback control, which is executed at a step S520 in FIG. 12.

FIG. 14 shows a subroutine for carrying out the low-response feedback control executed at the step S411 of the FIG. 10 subroutine. First, at a step S621, it is determined whether or not the STR flag FKSTR assumed "1" in the last loop. If FKSTR=0 held in the last loop, the program skips to a step S623, wherein the PID correction coefficient KLAF is calculated by executing the FIG. 8 subroutine, described hereinbefore. Then, the flag FKSTR is set to "0" at a step S624, and the program proceeds to a step S625, wherein the feedback correction coefficient KFB is set to the PID correction coefficient KLAF(k) calculated at the step S623, followed by terminating the present program.

On the other hand, if FKSTR=1 held in the last loop, the immediately preceding value KLAFI(k−1) of the integral term of the PID control is set to the immediately preceding value KSTR(k−1) of the adaptive control correction coefficient KSTR at a step S622, followed by the program proceeding to the step S623.

When changeover from the adaptive control to the PID control is carried out (if FKSTR=1 held in the immediately preceding loop and the engine is in the low-response F/B region in the present loop), there is a possibility of a drastic change in the integral term KLAFI of the PID control. Therefore, the step S622 is executed to set KLAF(k−1)=KSTR(k−1). This can reduce the difference between the adaptive control correction coefficient KSTR(k−1) and the PID correction coefficient KLAF(k), whereby smooth changeover from the adaptive control to the PID control can be carried out, to thereby ensure required stability of the engine control.

According to the processes of FIGS. 10 to 14 described above, at least when the engine combustion is in an unsteady condition, the air-fuel ratio feedback control is changed over from the adaptive control to the PID control, whereby sufficient accuracy and stability of the air-fuel ratio control can be ensured even when the engine is not in a steady operating condition, to thereby maintain excellent driveability and improved exhaust emission characteristics of the engine.

Figure 15:
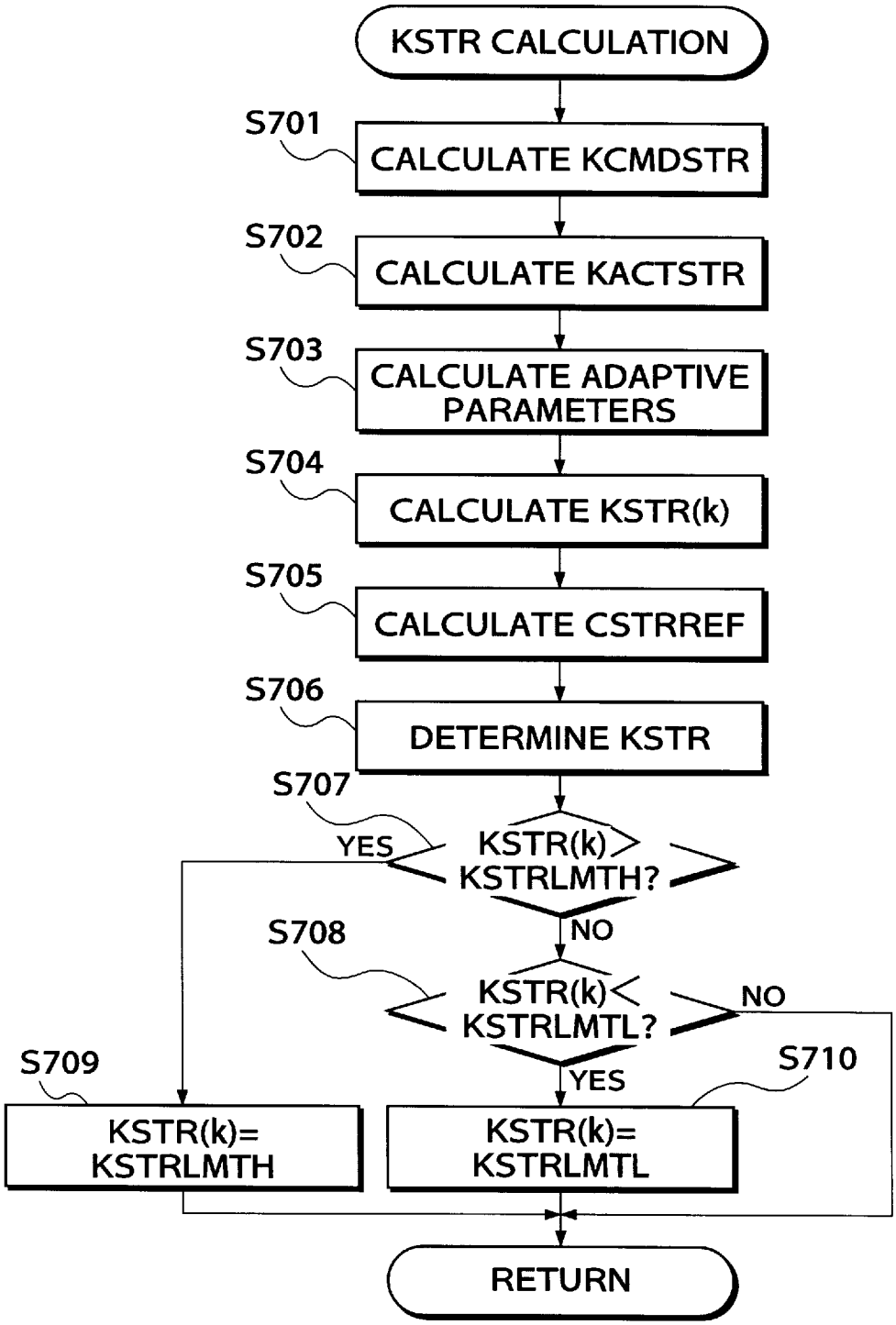
FIG. 15 is a flowchart showing a subroutine for calculating the adaptive control correction coefficient KSTR, which is executed at a step S603 in FIG. 13.

FIG. 15 shows a subroutine for carrying out the KSTR calculation, which is executed at the step S603 in FIG. 13.

First, at steps S701 and S702, a moving average value KCMDSTR of the desired air-fuel ratio coefficient KCMD and a moving average value KACTSTR of the actual equivalent ratio KACT are calculated by the use of the following equations (25A) and (25B), respectively, and the calculated average actual equivalent ratio KACTSTR is normalized by the calculated average desired equivalent ratio KCMDSTR by the use of the following equation (26):

$$KCMDSTR(k)=\{(KCMD(k)+KCMD(k-1)+KCMD(k-2)+KCMD(K-3)\}/4 \quad (25\text{ A})$$

$$KACTSTR(k)=\{(KACT(k)+KACT(k-1)+KACT(k-2)+KACT(K-3)\}/4 \quad (25\text{ B})$$

$$KACTSTR(k)=KACTSTR(k)/KCMDSTR(k-4\times d') \quad (26)$$

By executing the normalization by the above equation (26), the desired equivalent ratio in the aforesaid equation (23) always assumes 1.0, and therefore the equation (23) is transformed into the following equation (27):

$$KSTR(k) = \{1 - s_o \times KACTSTR(k) - r_1 \times KSTR(k-4) - r_2 \times KSTR(k-8) - r_3 \times KSTR(k-12)\}/b_o \quad (27)$$

Then, the average actual equivalent ratio KACTSTR(k) is substituted for the y(k) value in the aforesaid equations (18) and (21), to thereby calculate adaptive parameters by a subroutine of FIG. 16, described hereinafter, at a step S703. Further, the KACTSTR(k) value calculated by the equation (26) is applied to the equation (27), to thereby calculate the adaptive control correction coefficient KSTR(k) at a step S704, followed by the program proceeding to a step S705.

Figure 17:
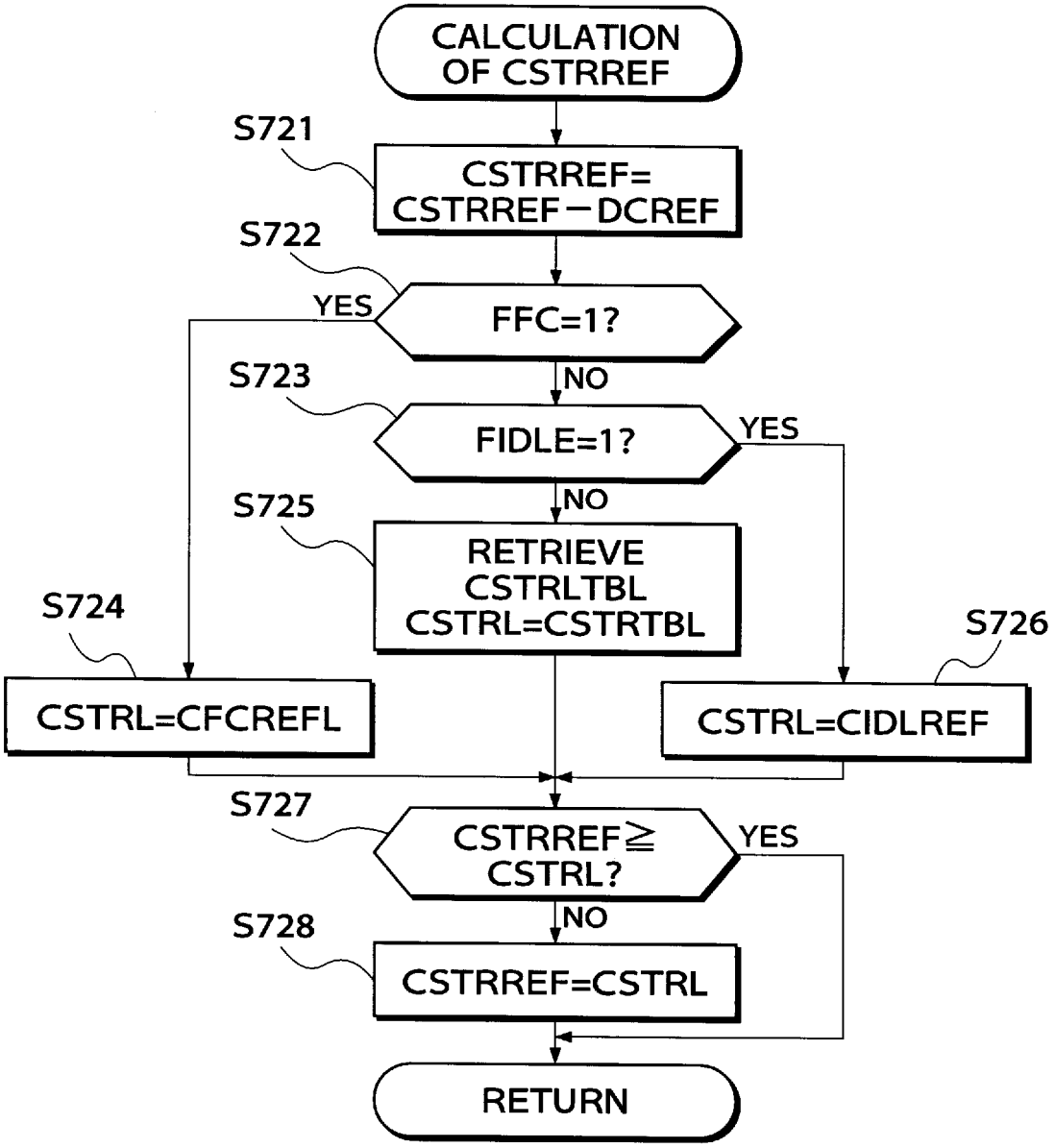
FIG. 17 is a flowchart showing a subroutine for calculating an averaging coefficient CSTRREF, which is executed at a step S705 in FIG. 15.
Figure 18:
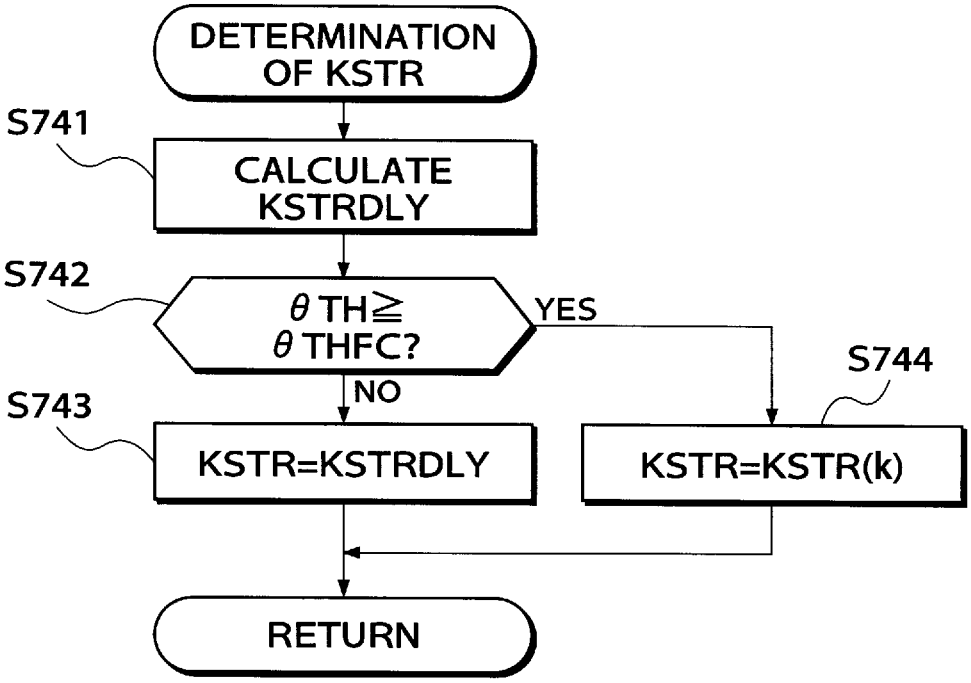
FIG. 18 is a flowchart showing a subroutine for calculating an averaged value KSTRDLY of an adaptive control correction coefficient KSTR(k), and selecting either the KSTR(k) value or the KSTRDLY value, which is executed at a step S706 in FIG. 15.

At the step S705 and a step S706, a CSTRREF calculation of FIG. 17 and a KSTR determination, described hereinafter with reference to FIGS. 17 and 18, are executed, respectively, and then at steps S707 to S710, limit-checking of the adaptive control correction coefficient KSTR(k) calculated at the step S706 is executed. More specifically, if the KSTR(k) value is larger than a predetermined upper limit value KSTRLMTH, the KSTR(k) value is set to the predetermined upper limit value KSTRLMTH, followed by terminating the present routine. On the other hand, if the KSTR(k) value is smaller than a predetermined lower limit value KSTRLMTL, the KSTR(k) value is set to the predetermined lower limit value KSTRLMTL, followed by terminating the present routine.

Figure 16:
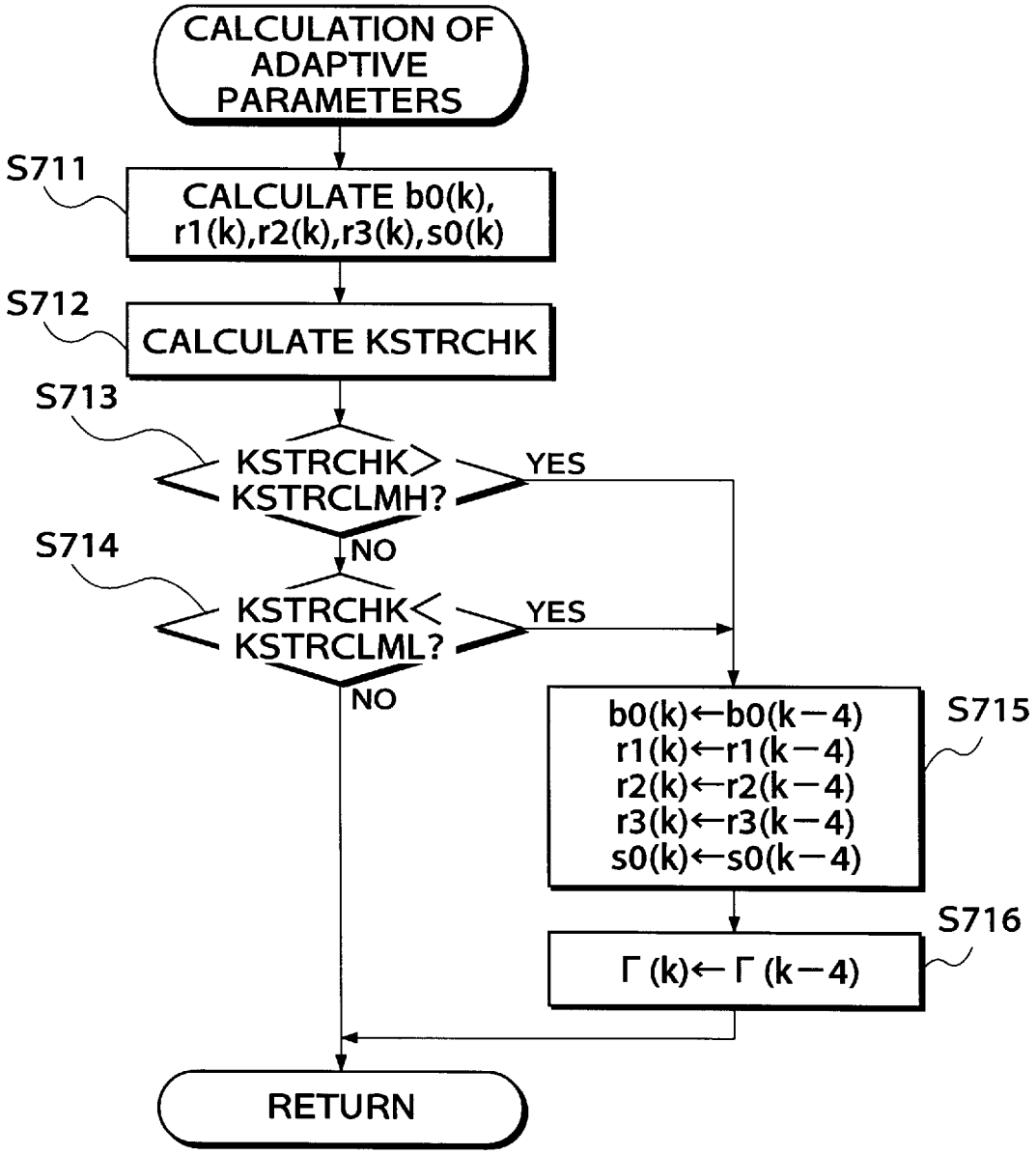
FIG. 16 is a flowchart showing a subroutine for calculating adaptive parameters, which is executed at a step S703 in FIG. 15.

FIG. 16 shows the subroutine for calculating the adaptive parameters, which is executed at the step S703 in FIG. 15.

At a step S711, adaptive parameters b0(k), r1(k), r2(k), r3(k) and s0(k) which are elements of the θΛ(k) value of the above equation (19) are calculated by the adaptive parameter adjusting mechanism. Then, these parameters are applied to the following equation (28), to thereby calculate a parameter KSTRCHK corresponding to the integral term of the adaptive control correction coefficient KSTR at a step S712:

$$KSTRCHK=\{1-s_0(k)\}/\{(b_0(k)+r_1(k)+r_2(k)+r_3(k)\} \quad (28)$$

Then, it is determined at steps S713 and S714 whether or not the calculated KSTRCHK value is larger than a predetermined upper limit value KSTRCLMH or smaller than a predetermined lower limit value KSTRCLML. If the answers are both negative (NO), the program is immediately terminated. On the other hand, if either KSTRCHK>KSTRCLMH or KSTRCHK<KSTRCLML holds, the adaptive parameters and the gain matrix Γ calculated by the equation (20) are held at respective last values thereof, which correspond to the same cylinder (values assumed four loops before in the present embodiment which is applied to a four-cylinder engine) at steps S715 and S716, followed by terminating the present routine.

The reason for using the KSTRCHK value calculated by the equation (28) as a parameter corresponding to the integral term is as follows: While in the case of the PID control, as shown in the aforesaid equation (8), the integral term KLAFI is in direct proportional relation to the PID correction coefficient KLAF and can be simply extracted from the equation (8) for limit-checking thereof, in the case of the adaptive control, the adaptive parameter s0, r1 to r3, and b0 form both the denominator and numerator of the equation (27), and accordingly the integral term cannot be extracted from the equation (27) in a simple manner. Therefore, according to the present embodiment, in the equation (27), an approximation is made such that KSTR(k−4)=KSTR(k−8)=KSTR(k−12)=KSTRO and the difference DKACT is defined as DKACT=KACTSTR−1.0 to obtain the following equation (29):

$$KSTR(k)=\{1-s_0-(r_1+r_2+r_3)\times KSTRO\}/b_0-s_0\times DKACT/b_0 \quad (29)$$

The second term ($-s_0\times DKACT/b_0$) on the right side of the equation (29) can be regarded as a proportional term, and therefore the remaining term obtained by removing the proportional term from the right side of the equation (29) corresponds to the integral term, i.e. the parameter KSTRCHK. Further, by effecting an approximation of KSTRO=KSTRCHK, the following equation (30) can be obtained:

$$KSTRCHK=\{1-s_0-(r_1+r_2+r_3)\times KSTRCHK\}/b_0 \quad (30)$$

By solving the equation (30) with respect to the value KSTRCHK, the above equation (28) is obtained.

Figure 19A:
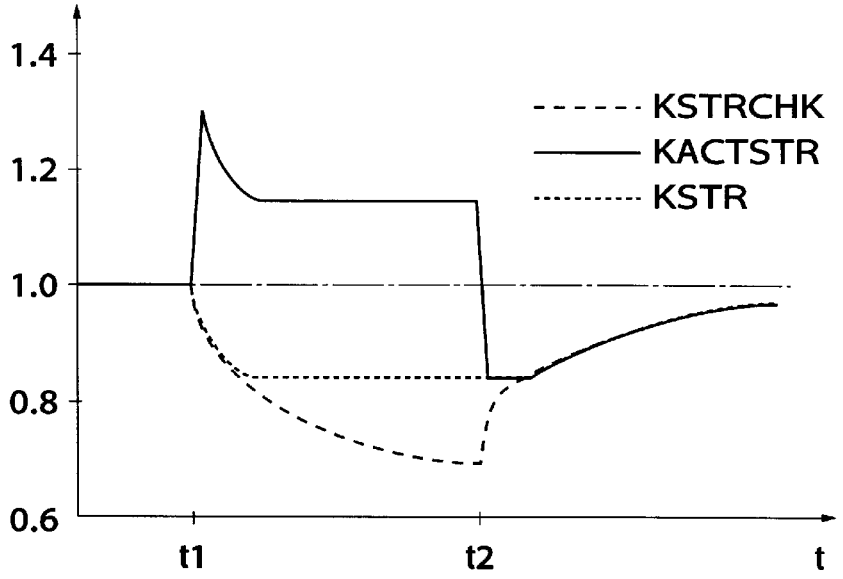
FIG. 19A is a graph showing changes in control parameters in response to a large disturbance, when limit-checking processing according to the invention is not carried out.
Figure 19B:
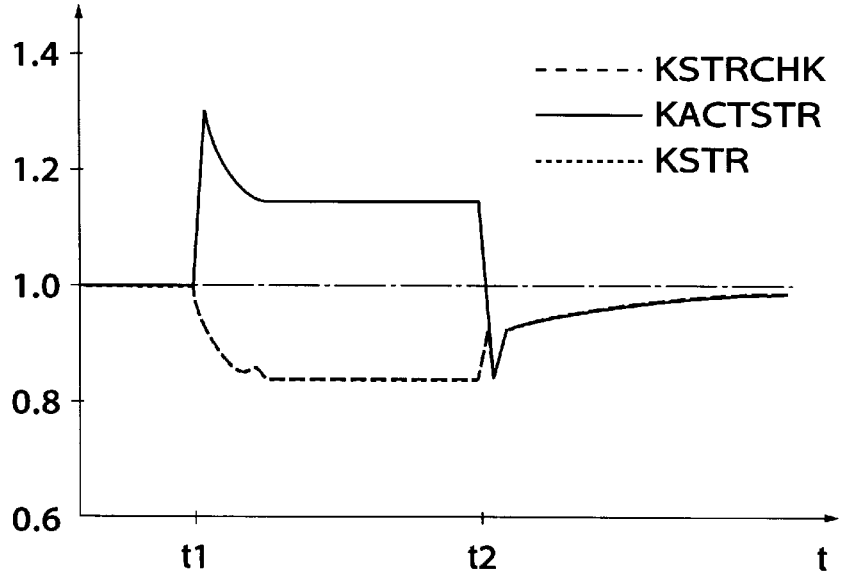
FIG. 19B is a graph showing changes in the control parameters in response to a large disturbance, when the limit-checking processing according to the invention is carried out.

FIGS. 19A and 19B are useful in explaining effects obtained by the limit-checking executed at the steps S713 to S716 in the FIG. 16 subroutine using the integral term-corresponding parameter KSTRCHK calculated by the use of the equation (28). In the example shown in the figures, it is assumed that a disturbance occurs during execution of the air-fuel ratio control over a time period between time points t1 and t2. FIG. 19A shows a case where the limit-checking of the steps S713 to S716 is not effected, while FIG. 19B shows a case where the limit-checking is effected. As is apparent from the figures, according to the present embodiment, since the integral term-corresponding parameter KSTRCHK of the adaptive control correction coefficient KSTR is also limit-checked, the air-fuel ratio KACTSTR obtained by the adaptive control can be promptly converged to a value assumed before the occurrence of the disturbance after the disturbance blows out.

FIG. 17 shows a subroutine for calculating an averaging coefficient CSTRREF for use in calculation of an averaged value KSTRDLY of the adaptive control correction coefficient KSTR, which is executed at a step S741 in FIG. 18, hereinafter referred to. The averaging coefficient CSTRREF is applied to an averaging equation (32) for averaging the adaptive control correction coefficient KSTR in the FIG. 18 subroutine.

First, at a step S721, the averaging coefficient CSTRREF is calculated by the use of the following equation (31):

$$CSTRREF=CSTRREF-DCREF \quad (31)$$

where DCREF represents a subtrahend set to a predetermined value. The averaging coefficient CSTRREF is initialized to a predetermined value when the engine is operating in a region other than the air-fuel feedback control region, and progressively decreased to a lower limit value CSTRL, referred to hereinbelow, by the use of the above equation (31) immediately after the adaptive feedback control is started.

At the following step S722, it is determined whether or not the fuel cut flag FFC assumes "1". If FFC=1 holds, the lower limit value CSTRL is set to a predetermined value CFCREFL to be applied during fuel cut, at a step S724, followed by the program proceeding to a step S727. If FFC=0 holds at the step S722, it is determined at a step S723 whether or not an idling flag FIDLE which, when set to "1", indicates that the engine is idling, assumes "1". If FIDLE=1 holds, the lower limit value CSTRL is set to a predetermined value CIDLREFL to be applied during idling of the engine, at a step S726, followed by the program proceeding to the step S727. The predetermined values CFCREFL and CIDLREFL are in the relationship of CFCREFL>CIDLREFL.

If FIDLE=0 holds at the step S723, a CSTRLTBL table is retrieved according to the engine rotational speed NE to determine a predetermined value CSTRTBL, and the lower limit value CSTRL is set to the determined predetermined value CSTRTBL at a step S725, followed by the program proceeding to the step S727.

At the step S727, it is determined whether or not the averaging coefficient CSTRREF is equal to or larger than the lower limit value CSTRL. If CSTRREF≧CSTRL holds, the program is immediately terminated, whereas if CSTRREF<CSTRL holds, the averaging coefficient CSTRREF is set to the lower limit value CSTRL at a step S728, followed by terminating the program.

FIG. 18 shows the subroutine for calculating the averaged value KSTRDLY of the KSTR(k) value and selecting either the KSTR(k) value or the KSTRDLY value depending upon the throttle valve opening θTH.

At the step S741, the averaged value KSTRDLY is calculated by the use of the following equation (32):

$$KSTRDLY=KSTRDLY\times CSTRREF/A+KSTR(k)\times(A-CSTRREF)/A \quad (32)$$

where A represents a predetermined value larger than the CSTRREF value, and KSTRDLY on the tight side the immediately preceding value of the averaged value KSTRDLY.

At the following step S742, it is determined whether or not the throttle valve opening θTH is equal to or larger than a predetermined value θTHFC. If θTH≧θTHFC holds, the KSTR value is set to the KSTR(k) value at a step S744, whereas if θTH<θTHFC holds, the KSTR value is set to the KSTRDLY value at a step S743, followed by terminating the program.

What is claimed is:

1. In an air-fuel ratio control system for an internal combustion engine having an exhaust system, including air-fuel ratio-detecting means arranged in said exhaust system, for detecting an air-fuel ratio of exhaust gases from said engine, and feedback control means for calculating an air-fuel ratio control amount, based on an output from said air-fuel ratio-detecting means, by using an adaptive controller having adaptive parameter-adjusting means for adjusting adaptive parameters, such that an air-fuel ratio of a mixture supplied to said engine is converged to a desired air-fuel ratio, and controlling said air-fuel ratio of said mixture supplied to said engine in a feedback manner, according to said air-fuel ratio control amount, the improvement wherein:

said adaptive parameter-adjusting means comprises integral term-corresponding parameter-calculating means for calculating a parameter corresponding to an integral term of said air-fuel ratio control amount, and limit-checking means for limit-checking a value of said parameter corresponding to said integral term so as to fall within a predetermined limit range.

2. An air-fuel ratio control system as claimed in claim 1, wherein said air-fuel ratio control amount (KSTR) is obtained by dividing a value obtained by subtracting from a difference (DKACT) between said desired air-fuel ratio (KCMD) and a product of an actual air-fuel ratio (KACT) and a first adaptive parameter (s0) products of a plurality of preceding values (KSTR(k--4), KSTR(k-8), KSTR(k-12)) and a plurality of respective second adaptive parameters (r1, r2, r3), by a third adaptive parameter (b0), said air-fuel ratio control amount (KSTR) being expressed by a formula including a proportional term (−s0×DKACT/b0) consisting of said difference (DKACT) and said first and third adaptive parameters (s0 and b0), by approximating said preceding values (KSTR(k-4), KSTR(k-8), KSTR(k-12)) to a predetermined value(KSTR0), said parameter (KSTRCHK) corresponding to said integral term being a term ({1−s0−(r1+r2+r3)×KSTR0}/b0) in said formula other than said proportional term.

3. An air-fuel ratio control system as claimed in claim 1, wherein said limit-checking means holds said adaptive parameters at respective preceding values thereof when said parameter corresponding to said integral term falls outside said predetermined limit range.

* * * * *